US011638852B2

(12) United States Patent
Tarkington et al.

(10) Patent No.: US 11,638,852 B2
(45) Date of Patent: May 2, 2023

(54) PORTABLE DEVICES FOR EXERCISING MUSCLES IN THE ANKLE, FOOT, AND/OR LEG, AND RELATED METHODS

(71) Applicant: TS MEDICAL LLC, McLean, VA (US)

(72) Inventors: Mary Anne Tarkington, McLean, VA (US); David G. Matsuura, Solana Beach, CA (US); Jacob A. Moebius, Encinitas, CA (US)

(73) Assignee: TS MEDICAL, LLC, McLean, VA (US)

( * ) Notice: Subject to any disclaimer, the term of this patent is extended or adjusted under 35 U.S.C. 154(b) by 0 days.

(21) Appl. No.: 17/045,257

(22) PCT Filed: Jan. 24, 2019

(86) PCT No.: PCT/US2019/015030

§ 371 (c)(1),
(2) Date: Oct. 5, 2020

(87) PCT Pub. No.: WO2019/194885

PCT Pub. Date: Oct. 10, 2019

(65) Prior Publication Data

US 2021/0361999 A1 Nov. 25, 2021

Related U.S. Application Data

(60) Provisional application No. 62/731,647, filed on Sep. 14, 2018, provisional application No. 62/653,906, filed on Apr. 6, 2018.

(51) Int. Cl.
*A63B 21/00* (2006.01)
*A63B 21/008* (2006.01)
(Continued)

(52) U.S. Cl.
CPC ..... *A63B 21/4015* (2015.10); *A63B 21/0087* (2013.01); *A63B 21/0421* (2013.01);
(Continued)

(58) Field of Classification Search
CPC ..... A63B 21/02; A63B 21/023; A63B 21/026; A63B 21/04; A63B 21/0407;
(Continued)

(56) References Cited

U.S. PATENT DOCUMENTS 1,509,793 A 9/1924 Thompson et al.
2,021,801 A 11/1935 Meyer
(Continued)

FOREIGN PATENT DOCUMENTS

CN 111184601 5/2020
DE 548527 C 10/1932
(Continued)

OTHER PUBLICATIONS

Office Action for U.S. Appl. No. 16/570,817, dated May 13, 2021.
(Continued)

*Primary Examiner* — Loan B Jimenez
*Assistant Examiner* — Zachary T Moore
(74) *Attorney, Agent, or Firm* — Jones Robb, PLLC

(57) ABSTRACT

A portable exercise device includes a pedal spaced away from and pivotably connected to a base and having a neutral position relative to a pivot axis. The pedal is configured to rotate about the pivot axis in a first direction toward the base and in a second direction, opposite the first direction, toward the base. The device also includes a resistance mechanism configured to exert a force on the pedal about the pivot axis in a direction opposite to the respective direction of rotation of the pedal. The device is movable between an open, in-use configuration, where the pedal is disposed in the neutral position to receive a foot and spaced away from the base,
(Continued)

and a closed configuration, where the pedal is adjacent the base.

20 Claims, 36 Drawing Sheets

(51) Int. Cl.
*A63B 21/04* (2006.01)
*A63B 21/055* (2006.01)
*A63B 23/08* (2006.01)
*A63B 21/16* (2006.01)
*A63B 22/00* (2006.01)

(52) U.S. Cl.
CPC ..... *A63B 21/0552* (2013.01); *A63B 21/4034* (2015.10); *A63B 21/4047* (2015.10); *A63B 23/085* (2013.01); *A63B 21/1672* (2015.10); *A63B 2022/0097* (2013.01)

(58) Field of Classification Search
CPC ..... A63B 21/0421; A63B 21/0435; A63B 21/045; A63B 21/0552; A63B 21/22; A63B 21/4013; A63B 21/4015; A63B 21/4019; A63B 21/4021; A63B 21/4033; A63B 21/4034; A63B 21/4047; A63B 22/0056; A63B 22/16; A63B 23/08; A63B 23/085
See application file for complete search history.

(56) References Cited

U.S. PATENT DOCUMENTS 2,268,747 A 1/1942 Gaugler
3,259,385 A 7/1966 Boren
3,286,709 A 11/1966 Hoyer et al.
3,318,304 A 5/1967 Vladimir et al.
3,421,760 A * 1/1969 Freeman, Jr. ..... A63B 21/1609 482/130
3,511,500 A 5/1970 Dunn
3,525,522 A * 8/1970 Piller ..... A63B 22/16 482/80
3,741,540 A 6/1973 Shimizu
4,111,416 A 9/1978 Jinotti
4,199,137 A 4/1980 Giguere
4,306,714 A 12/1981 Loomis et al.
4,337,939 A 7/1982 Hoyle et al.
4,370,977 A 2/1983 Mauldin et al.
4,422,635 A 12/1983 Herod et al.
4,429,868 A 2/1984 LeBlanc et al.
4,501,421 A 2/1985 Kane et al.
4,574,785 A 3/1986 Yamamoto
4,605,220 A 8/1986 Troxel
4,637,379 A 1/1987 Saringer
4,669,722 A 6/1987 Rangaswamy
4,694,684 A 9/1987 Campbell, III
4,718,665 A 1/1988 Airy et al.
4,733,859 A 3/1988 Kock et al.
4,739,986 A 4/1988 Kucharik et al.
4,779,866 A 10/1988 Marshall et al.
D299,063 S 12/1988 Young et al.
4,795,148 A 1/1989 Rangaswamy
4,801,138 A 1/1989 Airy et al.
4,816,920 A 3/1989 Paulsen
4,822,039 A * 4/1989 Gonzales ..... A63B 21/04 482/130
4,836,531 A 6/1989 Niks
4,979,737 A 12/1990 Kock
5,014,690 A 5/1991 Hepburn et al.
5,038,758 A 8/1991 Iams et al.
5,041,717 A 8/1991 Shay, III et al.
5,048,783 A 9/1991 Grimes
5,052,379 A 10/1991 Airy et al.
5,074,000 A 12/1991 Soltani et al.
5,108,092 A 4/1992 Hurst
5,129,872 A 7/1992 Dalton et al.
5,209,716 A 5/1993 Frydman et al.
5,215,508 A 6/1993 Bastow
5,230,681 A 7/1993 Hannum et al.
5,263,911 A 11/1993 Frydman et al.
5,306,222 A 4/1994 Wilkinson
5,337,737 A 8/1994 Rubin et al.
5,352,185 A 10/1994 Blauth et al.
5,368,536 A 11/1994 Stodgell
5,454,769 A 10/1995 Chen
5,465,428 A 11/1995 Earl
5,489,251 A 2/1996 Robles, Jr.
5,520,627 A 5/1996 Malewicz
5,570,472 A 11/1996 Dicker
5,582,567 A 12/1996 Chang
5,606,745 A 3/1997 Gray
5,611,770 A 3/1997 Tesch
5,645,516 A 7/1997 Foster
5,722,919 A 3/1998 Timmer
5,727,254 A 3/1998 Dicker
5,733,249 A 3/1998 Katzin et al.
5,743,837 A 4/1998 Dias et al.
5,755,651 A * 5/1998 Homyonfer ..... A63B 22/16 482/130
5,788,618 A 8/1998 Joutras
5,839,122 A 11/1998 Dicker et al.
5,842,959 A 12/1998 Wilkinson
5,851,166 A 12/1998 Bernardson
5,857,947 A 1/1999 Dicker et al.
5,867,826 A 2/1999 Wilkinson
5,873,847 A 2/1999 Bennett et al.
5,879,276 A 3/1999 Miller
5,897,464 A 4/1999 Mcleod
6,010,468 A 1/2000 Grove et al.
6,024,714 A 2/2000 Katzin
6,047,406 A 4/2000 Dicker et al.
6,063,013 A 5/2000 Vathappallil
6,206,807 B1 3/2001 Cowans et al.
6,217,488 B1 4/2001 Bernardson
6,244,992 B1 * 6/2001 James ..... A61H 1/0237 482/79
6,254,034 B1 7/2001 Carpenter
6,261,253 B1 7/2001 Katzin
6,277,057 B1 8/2001 Hayden
6,283,897 B1 9/2001 Patton
6,390,957 B1 5/2002 Knight
6,436,058 B1 8/2002 Krahner et al.
6,569,213 B1 * 5/2003 Busch ..... A63B 21/026 482/80
6,572,514 B1 * 6/2003 Calafato ..... A63B 22/16 482/79
6,589,141 B1 7/2003 Flaggs
6,656,097 B2 12/2003 Karecki
6,705,975 B2 * 3/2004 Kuo ..... A63B 23/0429 482/52
6,780,142 B1 * 8/2004 Takizawa ..... A63B 22/203 482/8
6,796,928 B1 * 9/2004 Christopher ..... A63B 22/0056 482/52
6,808,476 B2 * 10/2004 Zagone ..... A63B 21/023 482/80
6,821,235 B1 11/2004 Johnson et al.
6,837,831 B2 1/2005 Lee
7,008,357 B2 3/2006 Winkler
7,074,204 B2 7/2006 Fujii et al.
7,160,231 B2 1/2007 Kazemi
D538,814 S 3/2007 Cranford et al.
D553,379 S 10/2007 Genelli
7,294,114 B1 11/2007 Clement et al.
7,316,637 B2 1/2008 German et al.
7,322,904 B2 1/2008 Takizawa et al.
7,364,534 B2 4/2008 Zoller et al.
7,398,571 B2 7/2008 Souke et al.
7,452,340 B2 11/2008 Cook et al.
7,481,739 B2 1/2009 Takizawa et al.
7,481,751 B1 1/2009 Arnold
7,485,074 B2 2/2009 Chen

(56) References Cited

U.S. PATENT DOCUMENTS

| | | | | |
|---|---|---|---|---|
| 7,500,324 | B1 | 3/2009 | Power et al. | |
| 7,537,555 | B2 | 5/2009 | Soletski | |
| 7,641,591 | B2 | 1/2010 | Takizawa et al. | |
| D613,409 | S | 4/2010 | Genelli | |
| 7,771,327 | B1 * | 8/2010 | Reams | A63B 21/4034 482/80 |
| 7,775,941 | B2 | 8/2010 | Nguyen et al. | |
| 7,883,451 | B2 | 2/2011 | Hand | |
| 7,892,154 | B1 | 2/2011 | Alexa | |
| 7,918,813 | B2 | 4/2011 | Drake et al. | |
| 8,015,638 | B2 | 9/2011 | Shimada et al. | |
| 8,029,420 | B1 | 10/2011 | Thati | |
| 8,092,350 | B2 | 1/2012 | Chinag | |
| 8,123,663 | B2 | 2/2012 | Fey et al. | |
| 8,231,508 | B1 | 7/2012 | Rousseau | |
| 8,246,522 | B2 | 8/2012 | Piaget et al. | |
| 8,267,839 | B1 | 9/2012 | Bartolotta | |
| 8,312,566 | B2 | 11/2012 | Weir et al. | |
| 8,353,854 | B2 | 1/2013 | Horst et al. | |
| 8,360,940 | B2 | 1/2013 | Kole et al. | |
| 8,366,591 | B2 | 2/2013 | Patoglu | |
| 8,403,817 | B2 | 3/2013 | Ferguson et al. | |
| 8,430,796 | B1 * | 4/2013 | Tarkington | A63B 21/00189 482/52 |
| 8,460,163 | B2 | 6/2013 | Gibbons | |
| 8,480,546 | B2 | 7/2013 | Spencer | |
| 8,678,979 | B2 | 3/2014 | Stark et al. | |
| D712,044 | S | 8/2014 | Mathew et al. | |
| 8,827,873 | B2 | 9/2014 | Arnstein | |
| 8,840,530 | B2 | 9/2014 | Baker et al. | |
| 8,986,177 | B2 | 3/2015 | von Hoffmann et al. | |
| D726,844 | S | 4/2015 | Mathew et al. | |
| D734,411 | S | 7/2015 | Powers et al. | |
| 9,072,645 | B2 | 7/2015 | Gamman et al. | |
| 9,095,177 | B2 | 8/2015 | Ota et al. | |
| 9,114,277 | B2 | 8/2015 | Goeckel | |
| 9,192,806 | B2 | 11/2015 | Mial | |
| 9,230,057 | B2 | 1/2016 | Stark et al. | |
| 9,247,784 | B2 | 2/2016 | Stewart | |
| 9,295,303 | B2 | 3/2016 | Baker et al. | |
| 9,302,137 | B1 | 4/2016 | Yelvington | |
| 9,327,156 | B2 | 5/2016 | von Hoffmann et al. | |
| 9,377,079 | B2 | 6/2016 | DeHarde | |
| 9,433,814 | B2 | 9/2016 | von Hoffmann et al. | |
| 9,474,673 | B2 | 10/2016 | Horst et al. | |
| D776,211 | S | 1/2017 | Gebhard et al. | |
| 9,539,135 | B2 | 1/2017 | Romo et al. | |
| 9,566,469 | B1 | 2/2017 | Rector | |
| 9,592,416 | B2 | 3/2017 | Thorpe | |
| 9,603,768 | B1 | 3/2017 | Widmer et al. | |
| 9,656,117 | B2 | 5/2017 | von Hoffmann et al. | |
| 9,737,753 | B2 | 8/2017 | Chuang | |
| 9,770,617 | B2 | 9/2017 | von Hoffmann et al. | |
| 9,814,273 | B2 | 11/2017 | Nordstrom et al. | |
| 9,849,328 | B1 | 12/2017 | Fulks | |
| 9,872,789 | B2 | 1/2018 | Sorrenti et al. | |
| 9,873,017 | B2 | 1/2018 | Barel | |
| 9,895,569 | B2 | 2/2018 | Yao | |
| 9,914,009 | B2 | 3/2018 | Tarkington et al. | |
| 9,930,928 | B2 | 4/2018 | Whiteman et al. | |
| 9,931,540 | B1 | 4/2018 | Lazar et al. | |
| 10,004,937 | B2 | 6/2018 | Matsuura et al. | |
| 10,076,460 | B2 | 9/2018 | Harry et al. | |
| 10,118,063 | B2 | 11/2018 | DeYoung | |
| 10,124,205 | B2 | 11/2018 | Matsuura et al. | |
| D836,206 | S | 12/2018 | Pettinato et al. | |
| 10,143,878 | B2 | 12/2018 | Gottfried | |
| 10,179,078 | B2 | 1/2019 | Bhugra et al. | |
| 10,434,357 | B2 | 10/2019 | McCarthy | |
| 10,653,913 | B2 | 5/2020 | Yao et al. | |
| 10,702,740 | B2 | 7/2020 | Tarkington et al. | |
| 10,946,247 | B1 | 3/2021 | Burton | |
| 2002/0165069 | A1 | 11/2002 | Ravikumar et al. | |
| 2002/0193210 | A1 | 12/2002 | Turner | |
| 2003/0060339 | A1 | 3/2003 | Ravikumar et al. | |
| 2004/0087419 | A1 | 5/2004 | Ware et al. | |
| 2005/0251067 | A1 | 11/2005 | Terry | |
| 2005/0261113 | A1 | 11/2005 | Wilkinson | |
| 2006/0103219 | A1 | 5/2006 | Sardana | |
| 2006/0122040 | A1 | 6/2006 | Nguyen et al. | |
| 2006/0276736 | A1 | 12/2006 | Devreese | |
| 2007/0135279 | A1 | 6/2007 | Purdy et al. | |
| 2008/0083055 | A1 | 4/2008 | Onda | |
| 2009/0192024 | A1 | 7/2009 | Wu | |
| 2010/0145233 | A1 | 6/2010 | Zhang et al. | |
| 2010/0222180 | A1 | 9/2010 | Takizawa | |
| 2010/0323859 | A1 | 12/2010 | von Hoffmann et al. | |
| 2011/0046524 | A1 | 2/2011 | Mihara et al. | |
| 2011/0077560 | A1 | 3/2011 | Jacofsky et al. | |
| 2011/0111927 | A1 | 5/2011 | Kim | |
| 2011/0112447 | A1 | 5/2011 | Hsiao-Wecksler et al. | |
| 2011/0172578 | A1 | 7/2011 | Chiu et al. | |
| 2011/0314590 | A1 | 12/2011 | Perron et al. | |
| 2013/0041302 | A1 | 2/2013 | Williams | |
| 2013/0079686 | A1 | 3/2013 | Sessions | |
| 2013/0184617 | A1 | 7/2013 | Inaba | |
| 2013/0237386 | A1 | 9/2013 | Tsai | |
| 2014/0179497 | A1 | 6/2014 | von Hoffmann et al. | |
| 2014/0196190 | A1 | 7/2014 | Brown | |
| 2014/0302971 | A1 | 10/2014 | Vining | |
| 2014/0325732 | A1 | 11/2014 | Anderson | |
| 2014/0336009 | A1 | 11/2014 | Piaget et al. | |
| 2015/0165260 | A1 | 6/2015 | Tarkington et al. | |
| 2015/0223526 | A1 | 8/2015 | Nolan | |
| 2015/0314157 | A1 | 11/2015 | Lampert et al. | |
| 2016/0095367 | A1 | 4/2016 | Curran | |
| 2016/0183606 | A1 | 6/2016 | Shriver | |
| 2016/0256732 | A1 | 9/2016 | Kasner et al. | |
| 2016/0279012 | A1 | 9/2016 | Hurtado | |
| 2016/0361222 | A1 | 12/2016 | Publicover et al. | |
| 2017/0072250 | A1 | 3/2017 | Heiskanen | |
| 2017/0246501 | A1 | 8/2017 | Palmer | |
| 2017/0246502 | A1 | 8/2017 | Palmer | |
| 2017/0246503 | A1 | 8/2017 | Palmer | |
| 2017/0252601 | A1 | 9/2017 | McKenzie | |
| 2017/0274249 | A1 | 9/2017 | Moebius et al. | |
| 2017/0361151 | A1 | 12/2017 | Mottern | |
| 2018/0093121 | A1 | 4/2018 | Matsuura et al. | |
| 2018/0093122 | A1 | 4/2018 | Stevenson et al. | |
| 2018/0098707 | A1 | 4/2018 | Salamon et al. | |
| 2018/0104536 | A1 | 4/2018 | Stewart | |
| 2018/0111016 | A1 | 4/2018 | Brockway, Jr. et al. | |
| 2018/0207477 | A1 | 7/2018 | Barel | |
| 2019/0001176 | A1 | 1/2019 | Gustafson | |
| 2019/0029336 | A1 | 1/2019 | Collins et al. | |
| 2019/0160322 | A1 * | 5/2019 | McCarthy | A63B 21/4034 |
| 2020/0086170 | A1 | 3/2020 | Tarkington et al. | |
| 2020/0086172 | A1 | 3/2020 | Tarkington et al. | |
| 2020/0406093 | A1 | 12/2020 | Tarkington et al. | |
| 2021/0038943 | A1 | 2/2021 | Tarkington et al. | |
| 2022/0118311 | A1 | 4/2022 | Tarkington et al. | |

FOREIGN PATENT DOCUMENTS

| | | | |
|---|---|---|---|
| DE | 20221403 | U1 | 11/2005 |
| EP | 2854958 | | 4/2015 |
| EP | 2854958 | A1 | 4/2015 |
| FR | 3024838 | A3 | 2/2016 |
| GB | 2372458 | A | 8/2002 |
| GB | 2404877 | | 2/2005 |
| GB | 2404877 | A | 2/2005 |
| GB | 2460039 | A | 11/2009 |
| JP | 2009254700 | | 11/2009 |
| JP | 2009254700 | A | 11/2009 |
| WO | 2009128565 | | 10/2009 |
| WO | 2009128565 | A1 | 10/2009 |
| WO | 2013035905 | A1 | 3/2013 |
| WO | 2013101920 | | 7/2013 |
| WO | 2013181063 | | 12/2013 |
| WO | 2013181063 | A1 | 12/2013 |
| WO | 2015196190 | | 12/2015 |

(56) References Cited

FOREIGN PATENT DOCUMENTS

| | | | |
|---|---|---|---|
| WO | 2019164633 | A2 | 8/2019 |
| WO | 2019194885 | A1 | 10/2019 |

OTHER PUBLICATIONS

Notice of Allowance dated Aug. 19, 2021 in connection with U.S. Appl. No. 16/570,817, 12 pp.
Office Action dated Oct. 12, 2021 in related U.S. Appl. No. 29/724,141, 12 pages.
FF Finer form store, announced 2018 [online], [site visited Dec. 6, 2021], Available on internet, URL:https://www.amazon.com/ Finer-Form-Multi-Functional-Bench-Workout/dp/B07GYXF65S/ref=sr_1_196_sspa?dchiId=1&keywords=adjustable+ankle+and-foot +board &qid=1633368733&sr=8-196-spons&psc=1 (Year: 2018).
U.S. Pat. No. 0735319 to A.W. Urwick, dated Aug. 4, 1903.
Barwing, announced 2020[online], [site visited Dec. 6, 2021], Available on internet, URL:https://www.amazon.com/dp/B07WDHNKKB/ref=sspa_dk_detail_1?psc=1&pd_rd_i=B07WDHNKKB&pd_rd_w=ovafF&pf_rd_p=9fd3ea7c-b77c-42ac-b43b-c872d3f37c38&pd_rd_wg=K4R8E&pf_rd_r=QGNJ4V8P6PRKQYFAPHRE&pd_rd_r=c9b8a389 (Year: 2020).
Office Action dated Oct. 13, 2021 in related U.S. Appl. No. 16/918,671, 11 pages.
Office Action in U.S. Appl. No. 13/482,844, dated Aug. 31, 2012.
International Search Report and Written Opinion in PCT Appln No. PCT/US2013/042441, dated Sep. 6, 2013.
Office Action in CA Appln No. 2,874,237, dated Dec. 10, 2015.
Communication in EP Appln No. 13727007.0, dated Mar. 20, 2017.
International Search Report in PCT Appln No. PCT/US2019/015031, dated Aug. 30, 2019.
International Search Report in PCT Appln No. PCT/US2019/015030, dated Jul. 1, 2019.
Notice of Allowance in U.S. Appl. No. 16/570,742, dated Mar. 3, 2020.
Design U.S. Appl. No. 29/724,141, filed Feb. 12, 2020, 37 pages.
Design U.S. Appl. No. 29/746,283, filed Aug. 22, 2020, 62 pages.
U.S. Appl. No. 16/918,671, filed Jul. 1, 2020, 111 pages.
U.S. Appl. No. 16/975,577, filed Aug. 25, 2020, 83 pages.
Examination report dated Dec. 7, 2021 for Canadian Patent Application No. 197544.
Notices of Refusal for Korean Design Patent Application No. 30-2020-00306898, dated Sep. 3, 2021 and dated Aug. 30, 2021.
U.S. Appl. No. 17/562,682, filed Dec. 27, 2021.
Final Office Action dated Feb. 1, 2022 for Design U.S. Appl. No. 29/724,141.
Notice of Allowance dated Feb. 4, 2022 in U.S. Appl. No. 16/918,671.
Notice of Allowance dated Dec. 3, 2021 in Mexican Design Patent Application No. MX/f/2020/001920.
Examination report dated Feb. 15, 2022 for Canadian Design Patent Application No. 209921.
Notice of Allowance dated Apr. 19, 2022 in U.S. Appl. No. 29/724,141.
Notice of Allowance dated Apr. 26, 2022 in KR Application No. 30-2020-0036898.
Office Action dated Jun. 20, 2022 in U.S. Appl. No. 16/975,577, 15 pages.

* cited by examiner

PORTABLE DEVICES FOR EXERCISING MUSCLES IN THE ANKLE, FOOT, AND/OR LEG, AND RELATED METHODS

CROSS-REFERENCE TO RELATED APPLICATIONS

This application is a U.S. national stage application under 35 U.S.C. § 371(c) of International Application No. PCT/US2019/015030, filed Jan. 24, 2019, which claims priority to U.S. Provisional Patent Application No. 62/653,906, filed Apr. 6, 2018 and entitled "Portable Devices for Exercising Muscles in the Ankle, Foot, and/or Leg, and Related Methods," and to U.S. Provisional Patent Application No. 62/731,647, filed Sep. 14, 2018 and entitled "Portable Devices for Exercising Muscles in the Ankle, Foot, and/or Leg, and Related Methods," the entire content of each of which is incorporated by reference herein.

TECHNICAL FIELD

The present disclosure relates to portable devices for exercising muscles in the ankle, foot, and/or leg, and related methods. More particularly, the present disclosure relates to portable devices, and related methods, for exercising muscles in the ankle, foot, and/or leg of a user to increase blood circulation, which may, for example, assist in preventing venous thromboembolism.

INTRODUCTION

The section headings used herein are for organizational purposes only and are not to be construed as limiting the subject matter described in any way.

Venous thromboembolism (VTE) occurs when red blood cells, fibrin and, to a lesser extent, platelets and leukocytes, form a mass (i.e., clot) within an intact vein. The thrombus (i.e., blood clot) is referred to as a deep venous thrombosis (DVT) when formed within the deep veins of the legs or in the pelvic veins. A pulmonary embolism (PE) results when a piece of thrombus detaches from a vein wall, travels to the lungs, and lodges within the pulmonary arteries.

VTE is often a concern in situations where an individual is immobile and/or relatively nonambulatory for a relatively long period of time, such as, for example, during hospitalization, after surgery, during pregnancy and/or in the postpartum period, while traveling (e.g., in a car, plane and/or train), at work, and/or in a more sedentary lifestyle (e.g., the elderly and/or obese). Blood returning to the heart does so through veins. Large veins, such as those found in the legs, lie near and between muscles and contain valves that maintain the flow of blood in the direction of the heart by preventing backflow and stasis. The contraction of these muscles (e.g., through walking) forces the blood through the veins in the direction of the heart, usually against the force of gravity, thereby preventing blood from accumulating in the extremities. If these muscles are not used and/or minimally (e.g., infrequently) used for an extended period of time, however, the lower limbs may swell with stationary blood, greatly increasing the risk of VTE.

Because of this potential danger, preventative measures against VTE have become standard, for example, in prolonged hospitalizations and postoperative care. Consequently, in conjunction with early ambulation, a number of prophylaxis devices have been developed to help prevent VTE, including, for example, graduated compression stockings, intermittent pneumatic compression devices, and pneumatic compression devices. Such compressive techniques, however, fail to treat and articulate a patient's ankle and/or knee joints, or otherwise contract the ankle, foot and/or leg (e.g., calf) muscles. These devices and methods, therefore have limited exercise and therapy capabilities, and are generally impractical for use outside of a hospital setting.

Various additional exercise devices serve to articulate a patient's joints, thereby providing joint therapy while contracting the muscles of the ankle, foot, and/or leg to prevent blood from accumulating in the lower extremities of the body. Such devices, however, often fail to allow both full flexion and extension of a user's ankle, to provide both plantar flexion (i.e., movement which increases the approximate 90° angle between the front part of the foot and the shin, thereby contracting the calf muscle) and dorsiflexion motion (i.e., movement which decreases the angle between the front part of the foot and the shin, thereby stretching the calf muscle). Furthermore, many of these devices are bulky, cumbersome, complex and expensive; being impractical for use during transition care or between care locations, or for use by other VTE at-risk groups, such as, for example, travelers.

Due to growing concerns over the continued prevalence of VTE related medical cases, it may be desirable to provide a relatively simple, inexpensive device and method with full exercise and therapy capabilities, which allows for full flexion and extension of a user's ankle joint, while also being lightweight and compact. It also may be desirable to provide a device that is portable, being useful for all VTE at-risk individuals.

SUMMARY

The present disclosure may solve one or more of the above-mentioned problems and/or may demonstrate one or more of the above-mentioned desirable features. Other features and/or advantages may become apparent from the description that follows.

In accordance with various exemplary embodiments of the present disclosure, a portable exercise device includes a pedal spaced away from and pivotably connected to a base and having a neutral position relative to a pivot axis. The pedal is configured to rotate about the pivot axis in a first direction toward the base and in a second direction, opposite the first direction, toward the base. The portable exercise device also includes a resistance mechanism configured to exert a force on the pedal about the pivot axis in a direction opposite to the respective direction of rotation of the pedal about the pivot axis. The portable exercise device is movable between an open, in-use configuration, where the pedal is disposed in the neutral position to receive a foot of a user and spaced away from the base, and a closed configuration, where the pedal is adjacent the base.

In accordance with various additional exemplary embodiments of the present disclosure, a portable exercise device includes at least one pedal pivotably connected to a base and having a neutral position relative to a pivot axis. The pedal comprises a toe end portion and a heel end portion, wherein the pivot axis is below the pedal and is approximately centered between the toe end portion and the heel end portion. The pedal is configured to rotate about the pivot axis in a first direction away from the neutral position in which the toe end portion moves toward the base and in a second direction away from the neutral position in which the heel end portion moves toward the base, such that rotation of the pedal in the first direction and the second direction, sequentially, moves the pedal in a rocking motion. The portable exercise device also includes a resistance mechanism configured to exert a force on the pedal about the pivot axis in a direction opposite to the respective first and second directions of rotation of the pedal about the pivot axis.

In accordance with various further exemplary embodiments of the present disclosure, a method for exercising muscles in an ankle, foot, and/or leg of a user includes positioning a foot of a user onto a pedal of an exercise device. The pedal is spaced away from and pivotably connected to a base of the device and has a neutral position relative to a pivot axis. The method also includes rotating the pedal with the foot in a first direction about the pivot axis to move a first end of the pedal toward the base. The method further includes resisting a pivoting motion of the pedal with a force exerted against a second end of the pedal in a direction opposite to the first direction of rotation.

In accordance with various further exemplary embodiments of the present disclosure, a method for exercising muscles in an ankle, foot, and/or leg of a user, comprises increasing fluid circulation velocity within body tissue by, with a foot of a user positioned on a pedal of an exercise device, the pedal being spaced away from and pivotably connected to a base of the device and having a neutral position relative to a pivot axis, rotating the pedal with the foot in a first direction about the pivot axis to move a first end of the pedal toward the base and resisting a pivoting motion of the pedal with a force exerted against a second end of the pedal in a direction opposite to the first direction of rotation. The method further includes rotating the pedal with the foot in a second direction, opposite to the first direction, to move the second end of the pedal toward the base and resisting the rotation in the second direction with a force exerted against the first end of the pedal in a direction opposite to the second direction of rotation.

Additional objects and advantages will be set forth in part in the description which follows, and in part will be obvious from the description, or may be learned by practice of the present disclosure. The objects and advantages may be realized and attained by means of the elements and combinations particularly pointed out in the appended claims and their equivalents.

It is to be understood that both the foregoing general description and the following detailed description are exemplary and explanatory only and are not restrictive of the present disclosure and claims.

BRIEF DESCRIPTION OF THE DRAWINGS

The present disclosure can be understood from the following detailed description either alone or together with the accompanying drawings. The drawings are included to provide a further understanding, and are incorporated in and constitute a part of this specification. The drawings illustrate one or more exemplary embodiments of the present disclosure and together with the description serve to explain various principles and operations.

DESCRIPTION OF VARIOUS EXEMPLARY EMBODIMENTS

Figure 1:
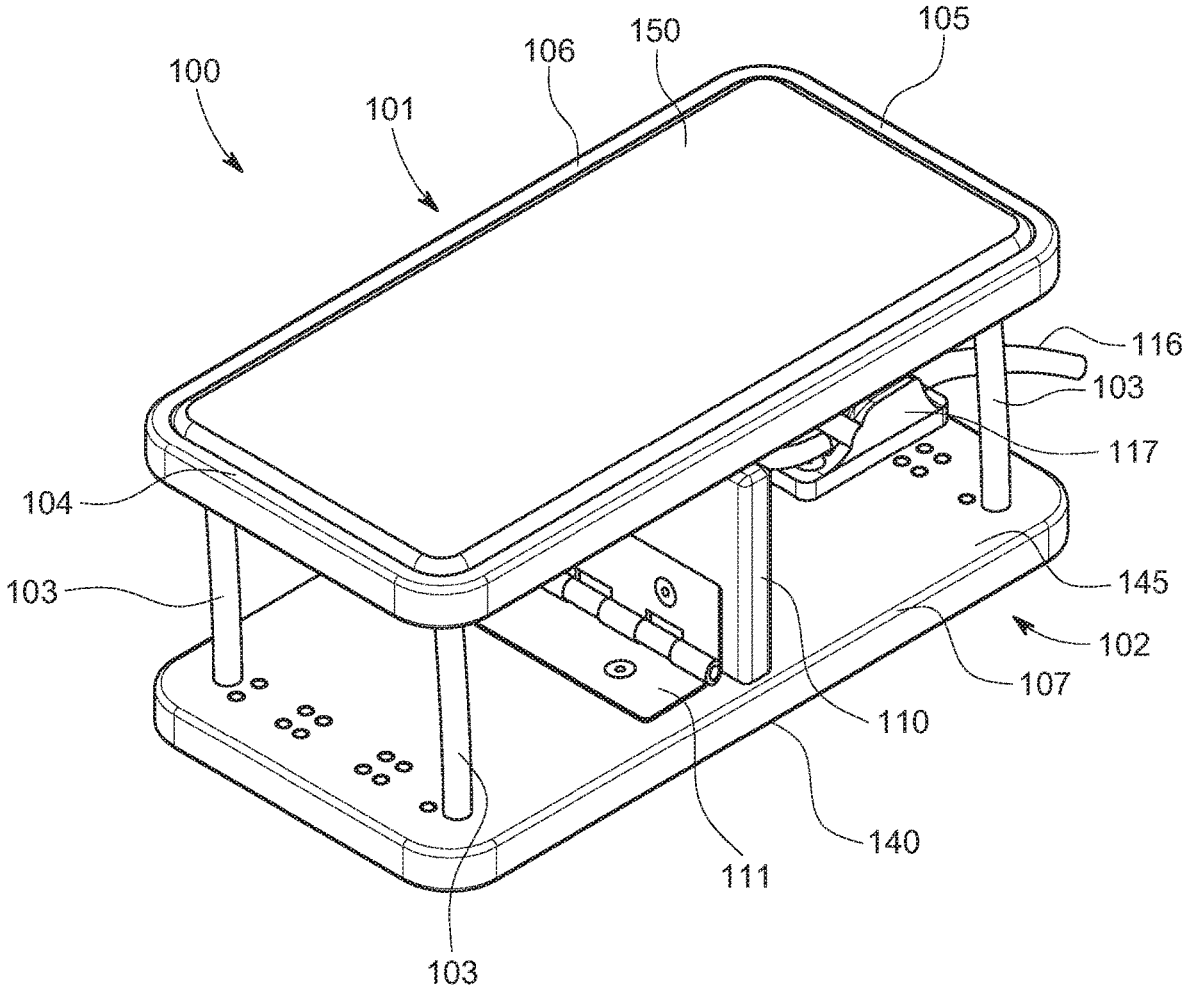
FIG. 1 is a perspective top, front view of an exemplary embodiment of a portable exercise device, in an open configuration, in accordance with the present disclosure.
Figure 2:
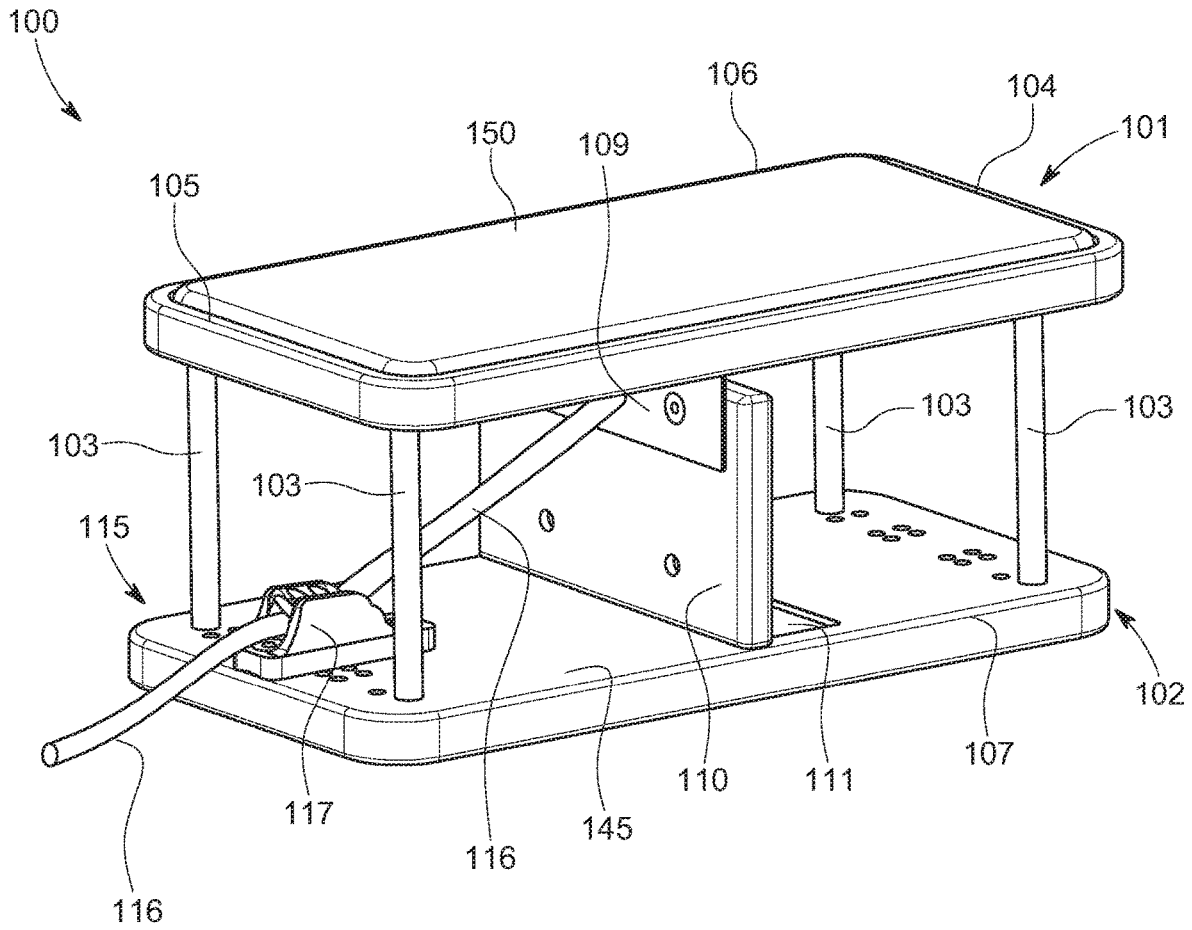
FIG. 2 is a perspective side, back view of the device of FIG. 1 in the open configuration.
Figure 3:
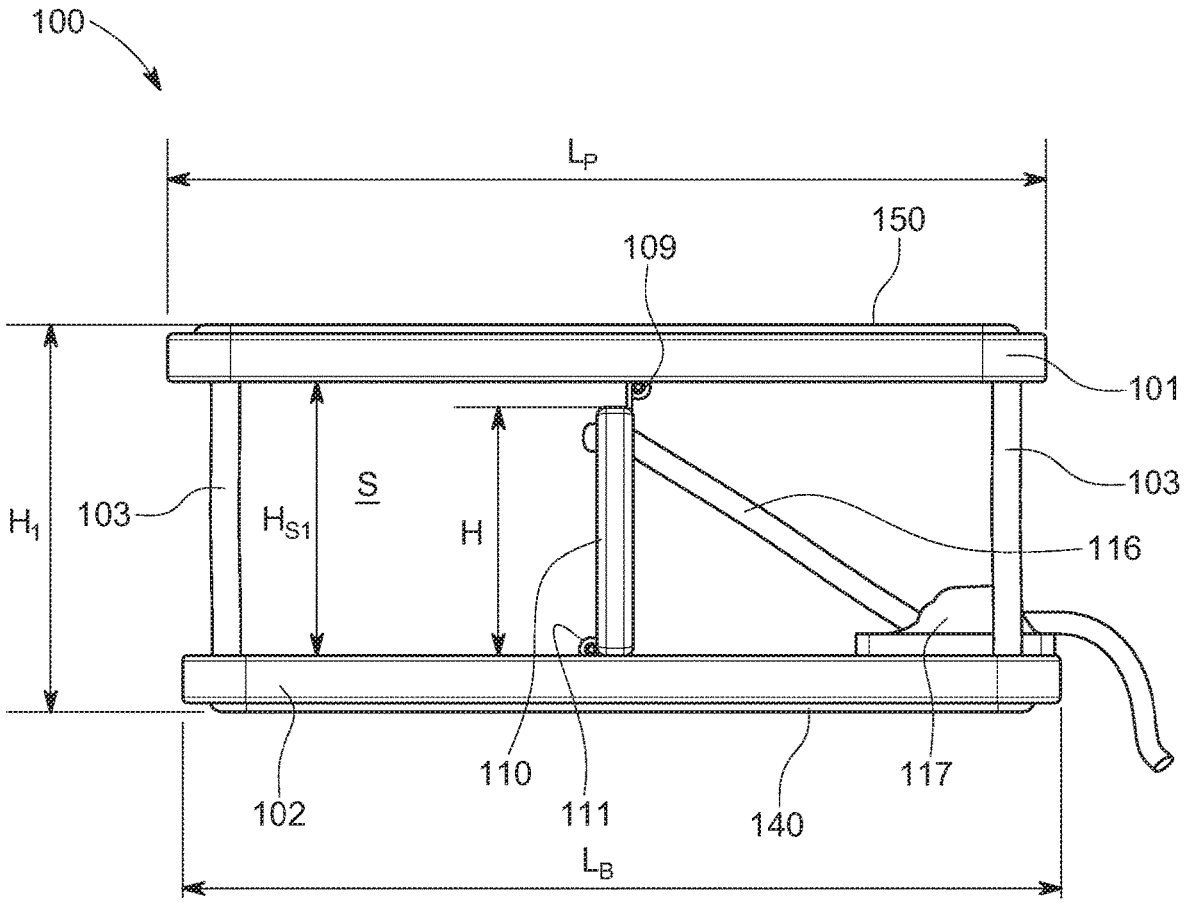
FIG. 3 is a side view of the device of FIG. 1 in the open configuration.
Figure 4:
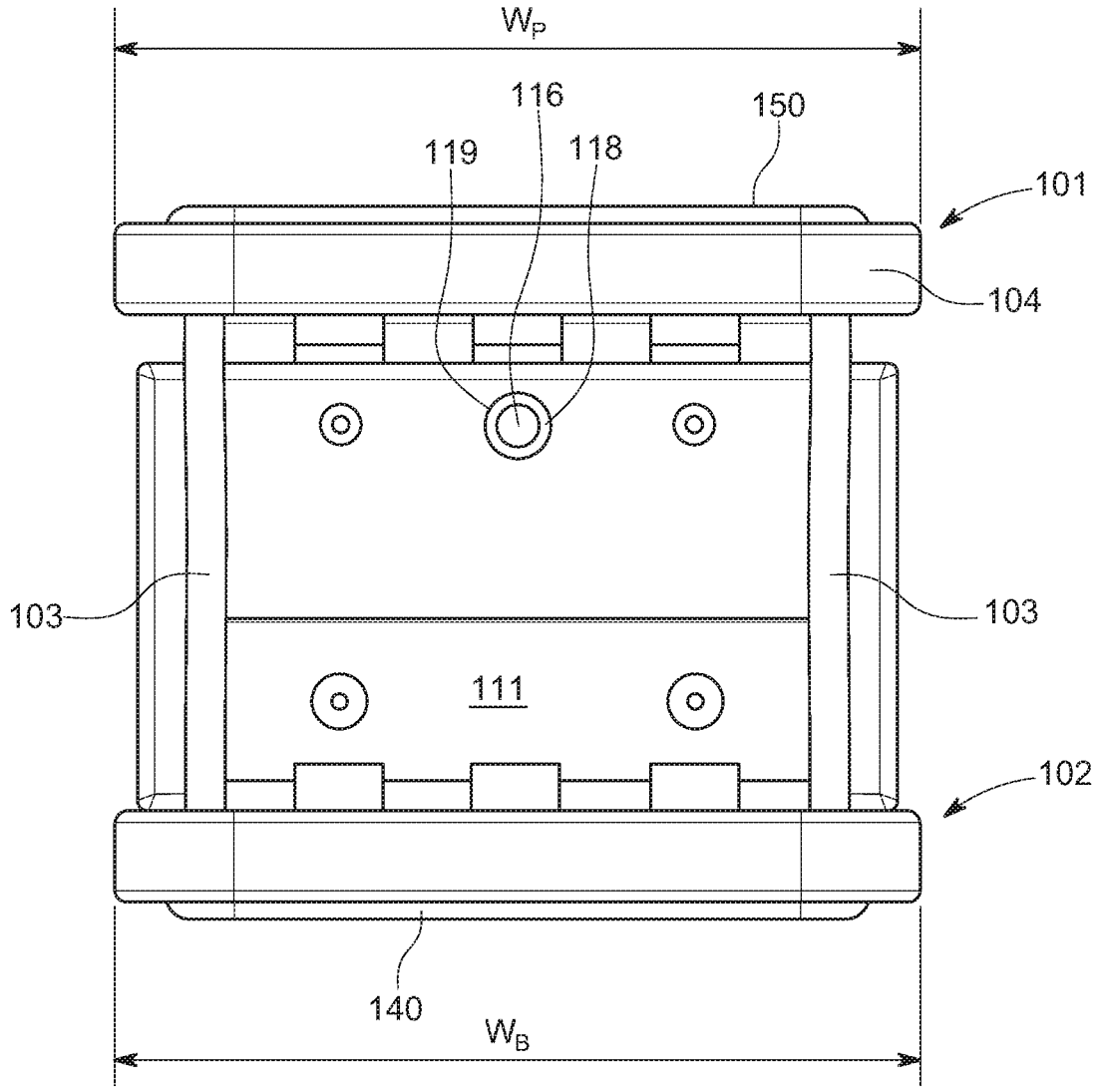
FIG. 4 is a front view of the device of FIG. 1 in the open configuration.
Figure 5:
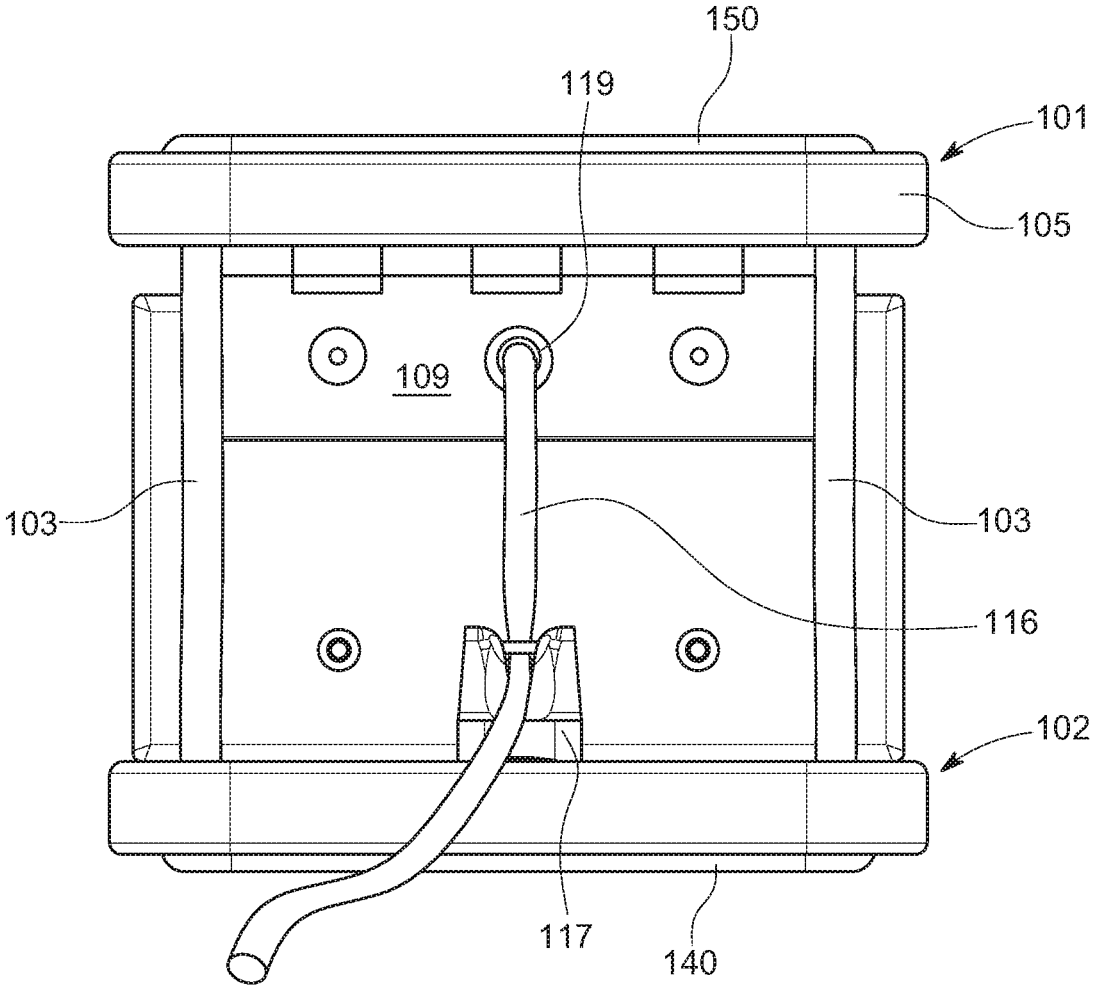
FIG. 5 is a back view of the device of FIG. 1 in the open configuration.

Various conventional thromboprophylaxis techniques typically rely on devices that are cumbersome, complex, and/or expensive. Consequently, such devices are generally impractical for use during transition care or between care locations, or for use by other VTE vulnerable groups, such as, for example, expectant mothers, travelers and/or other individuals sitting for extended periods. To increase thromboprophylaxis utilization, various exemplary embodiments of the present disclosure provide portable devices for exercising an ankle, foot and/or leg, and methods of using such devices, that provide simple and relatively inexpensive prophylaxis by providing full flexion and extension of the ankle joint to increase circulation in the lower extremities of the body. Increasing circulation may include increasing circulation in body tissues. Movement of bodily fluids, including blood, lymph, and/or interstitial fluids may be achieved through practice of the disclosed methods and use of the disclosed devices. The increased circulation may be found in one or more of blood vessels, the lymphatic system, muscles, interstitial spaces, capillaries and surrounding body tissues. In addition to the movement of fluids through ankle flexion and extension, the pressure applied to the sole of the foot during the exercise, i.e., plantar pressure, also contributes to movement of fluid through the body tissue and to an increase in circulation of bodily fluids.

In various exemplary embodiments, portable exercise devices for exercising an ankle, foot and/or leg, and related methods, use at least one pedal that is pivotably connected to a base about a pivot axis. The pedal has a neutral position relative to the pivot axis and is generally positioned such that the pivot axis is centrally located along a length of the pedal. When the pedal is in the neutral position, the pedal is substantially parallel to the base and there is a space between the pedal and the base. In this manner, the pedal is configured to rotate about the pivot axis in a first direction away from the neutral position and toward the base (where a first end of the pedal moves toward the base) and in a second direction away from the neutral direction and toward the base (where a second end of the pedal moves toward the base), wherein the second direction is opposite the first direction.

The devices and methods also use a resistance mechanism that is configured to exert a force on the pedal about the pivot axis in a direction opposite to a respective direction of rotation of the pedal about the pivot axis. For example, in accordance with various embodiments, to exercise the ankle, foot, and/or leg of the user, as explained further below, the force exerted by the resistance mechanism is configured to provide a passive resistance to the rotational movement of the pedal. In other words, the resistance mechanism is configured to provide a passive resistance against the rotation of the pedal throughout a full range of ankle flexion and ankle extension.

In accordance with the present disclosure, a pivot axis of the device may be located at a point configured to be positioned below a user's ankle during use. In some embodiments, the pivot axis of the device may be located at a point configured to be positioned below a central portion of a user's foot during use, such that the user's foot undergoes a rocking motion as it moves through a full range of ankle flexion and ankle extension.

Figure 14:
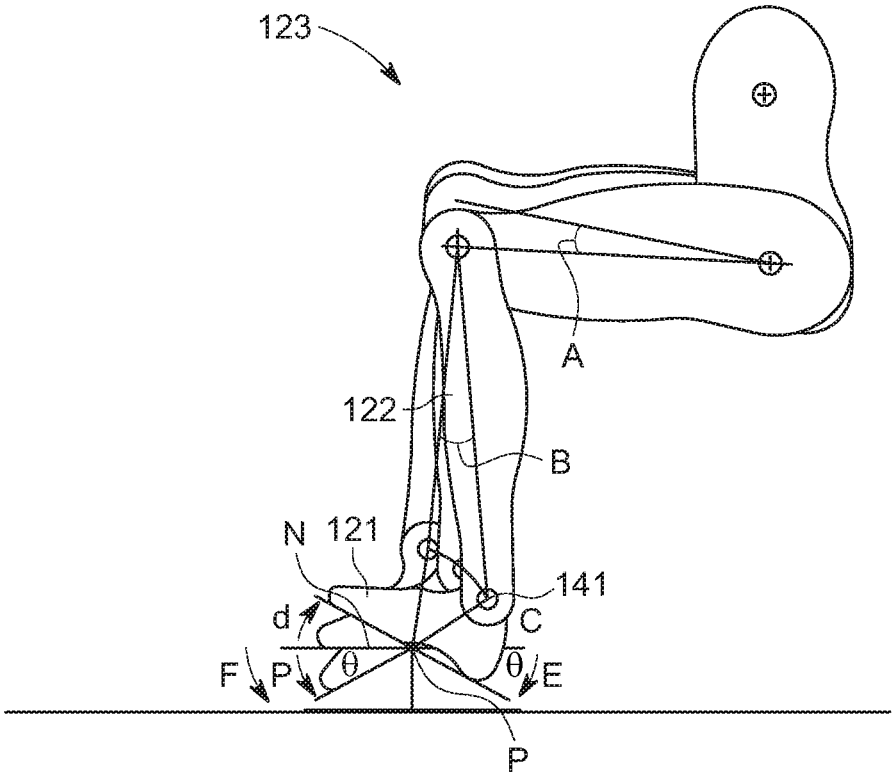
FIG. 14 is a diagram of an exemplary range of motion of the portable exercise devices in accordance with the present disclosure.
Figure 15:
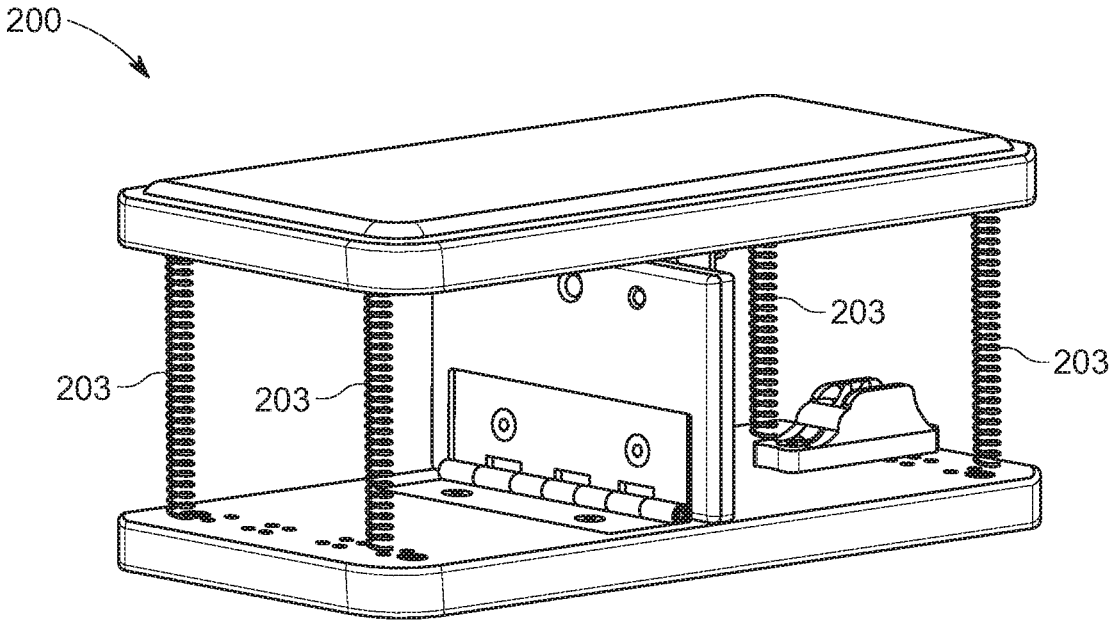
FIG. 15 is a perspective view of another embodiment of a portable device, in an open configuration, in accordance with the present disclosure.
Figure 16:
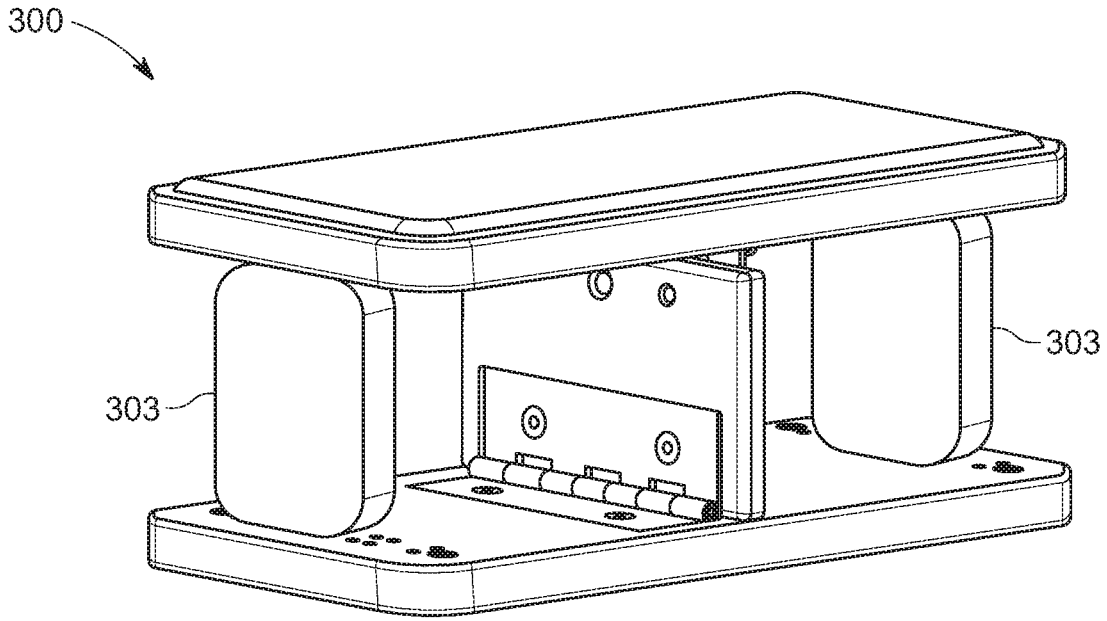
FIG. 16 is a perspective view of another embodiment of a portable device, in an open configuration, in accordance with the present disclosure.
Figure 17:
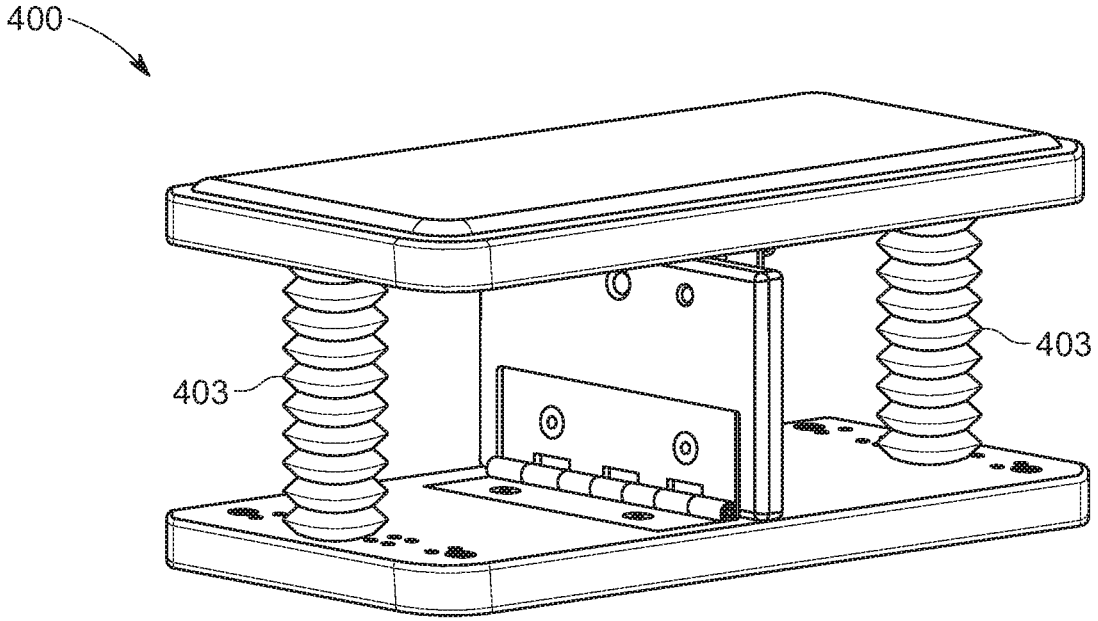
FIG. 17 is a perspective view of yet another embodiment of a portable device, in an open configuration, in accordance with the present disclosure.
Figure 18:
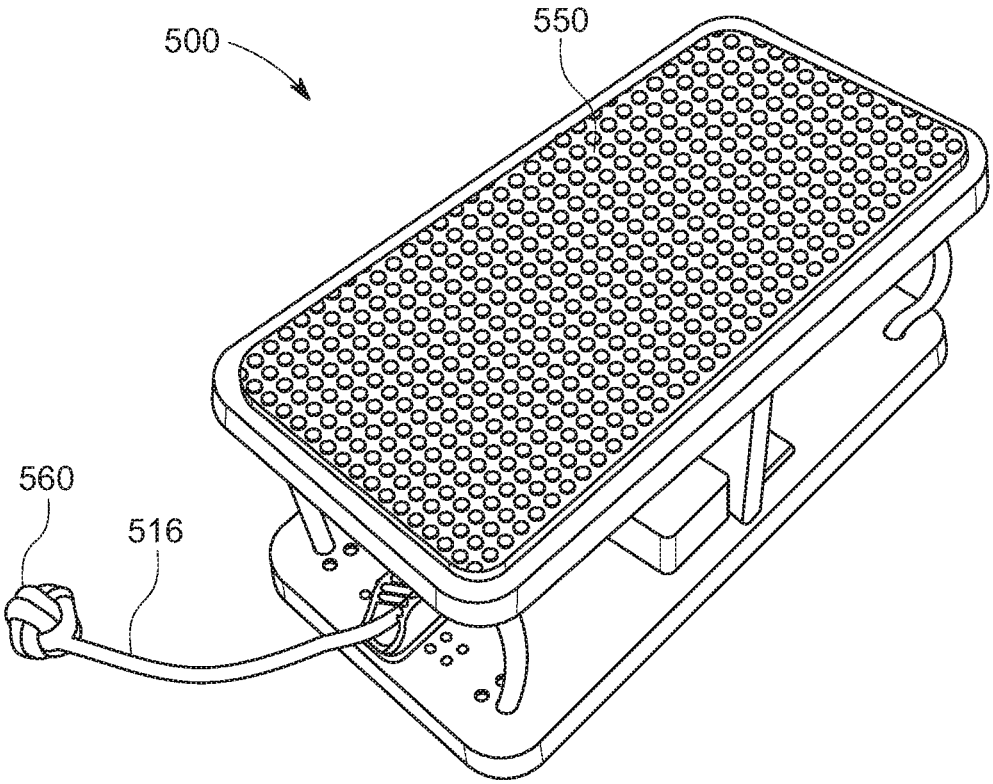
FIG. 18 is a perspective top view of yet another embodiment of a portable exercise device, in an open configuration, in accordance with the present disclosure.
Figure 19:
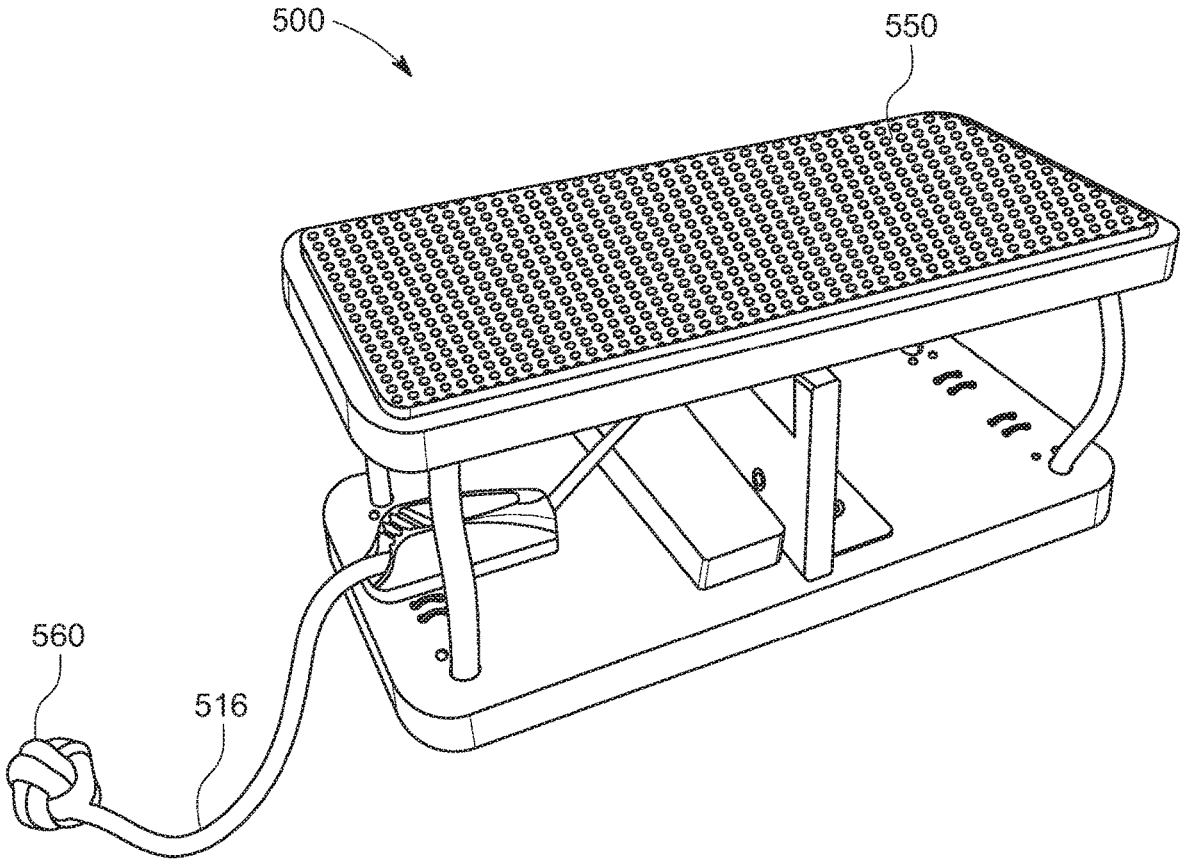
FIG. 19 is a perspective side, front view on the device of FIG. 18 in the open configuration.
Figure 20:
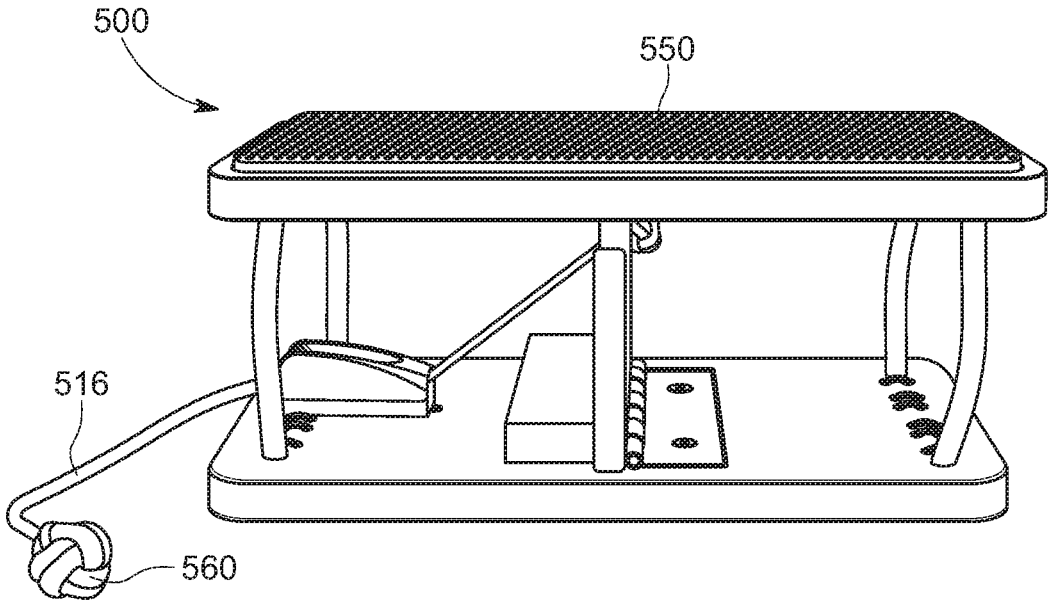
FIG. 20 is a perspective side view of the device of FIG. 18 in the open configuration.
Figure 21:
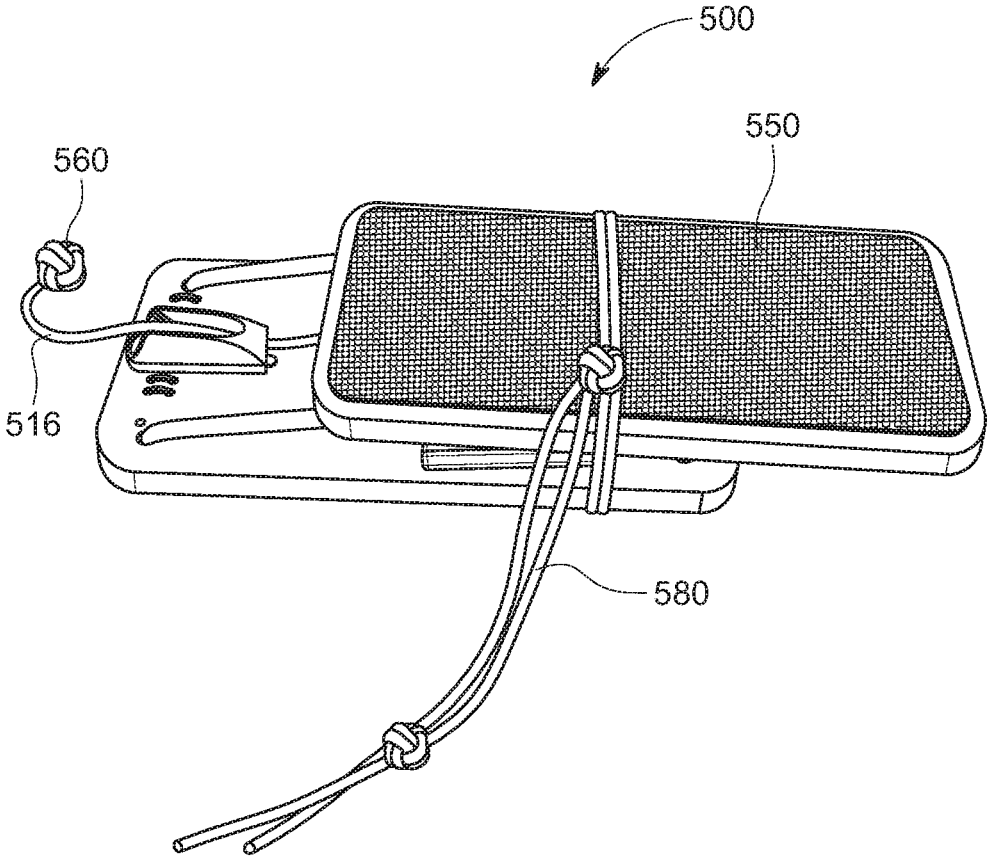
FIG. 21 is a perspective side, top view of the device of FIG. 18 in a closed configuration.

As used herein, the term "full range of ankle flexion and ankle extension" refers to the complete range of motion that the joints of a healthy user's ankle may undergo. In accordance with exemplary embodiments of the present disclosure, as illustrated in FIG. 14, a full range of ankle flexion and extension includes about 75 degrees of plantar flexion motion p (e.g., rotation ranging from about neutral to 75 degrees); and about 60 degrees of dorsiflexion motion d (e.g., rotation ranging from about neutral to −60 degrees). It will be understood, however, that the ambulatory ability of a user may be limited, and that, accordingly, the range of ankle flexion and ankle extension of each individual user may vary and be somewhat to significantly less than the full range of ankle flexion and ankle extension.

Accordingly, as illustrated in the exemplary embodiments shown in the drawings, a portable exercise device in accordance with the present disclosure has a simple configuration, which includes three main parts: 1) a base, 2) at least one pedal pivotably connected to the base, and 3) a resistance mechanism which is configured to resist the rotation of the pedal with respect to a neutral position in at least two opposite directions. Furthermore, for portability, devices in accordance with the present disclosure are adjustable to at least two configurations: 1) an open, in use configuration, wherein the pedal is spaced away from the base to enable the pedal to rotate relative to the base, the pedal being disposed in the neutral position to receive a foot of a user, and 2) a closed configuration, wherein the pedal is adjacent to, collapsed against, or otherwise positioned near the base to minimize a space between the pedal and the base, and thereby the size of the device. The closed configuration does not permit use of the device but is configured to facilitate storage and/or transport of the device.

FIGS. 1-7 illustrate an exemplary exercise device 100, in accordance with an exemplary embodiment of the present disclosure, in an open, in use configuration. FIGS. 8-12 show the exercise device 100 in a closed configuration. As shown in FIGS. 1-12, the exercise device 100 includes a base 102, a pedal 101, and a resistance mechanism 103, with a set of four resistance mechanisms 103 being shown in the embodiment of FIGS. 1-12. As shown, the pedal 101 includes a toe end portion 104 and a heel end portion 105, and the pedal 101 is pivotably connected to the base 102 substantially midway between the toe end portion 104 and the heel end portion 105 of pedal 101, as will be described in further detail below. As illustrated best perhaps in FIGS. 6 and 7, the base 102 provides a bottom surface 140 configured to support the device 100 against a support surface (e.g., the floor, ground, or a vertical support board 160) and configured to resist movement of device 100 relative to the support surface 160 while a user 123 is using the device 100. The pedal 101 provides a foot surface 150 configured to receive and support a foot 121 of the user 123 while the user 123 is using the device 100, as will be described in more detail below.

The pedal 101 may be formed from any material suitable for receiving and supporting the foot of a user in accordance with the present disclosure. In various exemplary embodiments, the pedal 101 may, for example, comprise a molded plastic material, such as, for example, a molded polypropylene material. Those of ordinary skill in the art will understand, however, that the pedal 101 may be made of various plastic materials, as well as various other materials, including, for example, wood and/or metal materials, as described further below. Suitable materials can include, for example, materials that are relatively light to facilitate carrying, packing, and transporting the device 100, yet durable and able to withstand repetitive use/motion.

Figure 6:
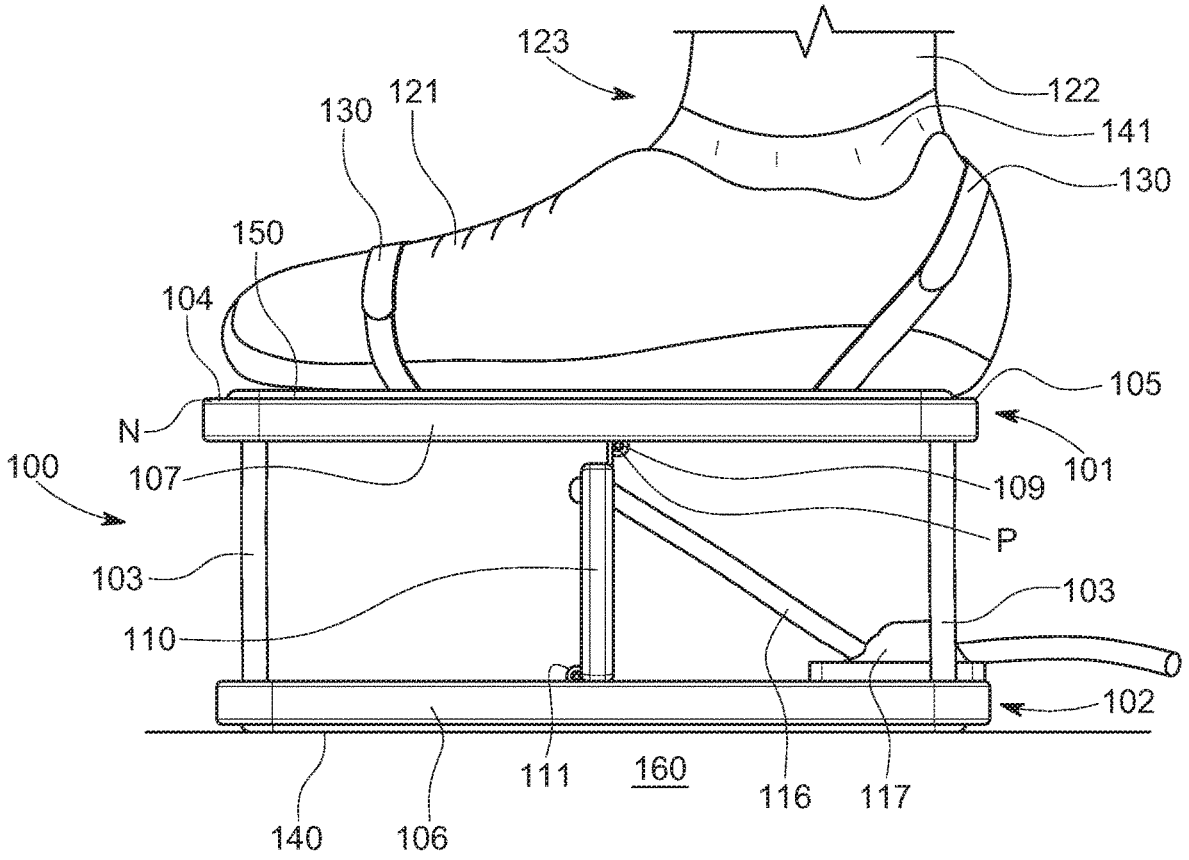
FIG. 6 is a side view of the device of FIG. 1 in the open configuration, showing a user's foot strapped to the device for use in a sitting position.
Figure 7:
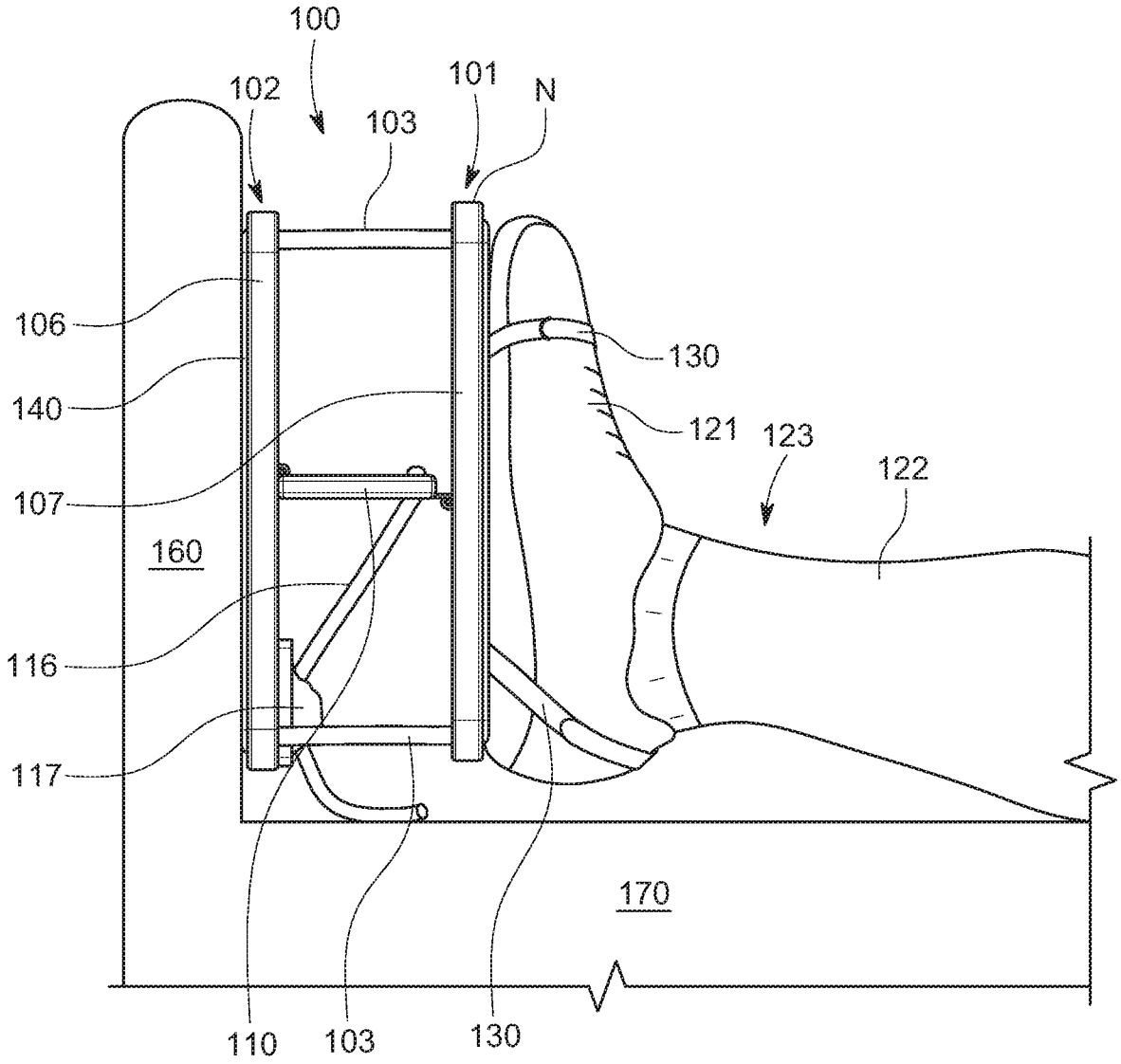
FIG. 7 is a side view of the device of FIG. 1 in the open configuration, showing a user's foot strapped to the device for use in a supine position.
Figure 8:
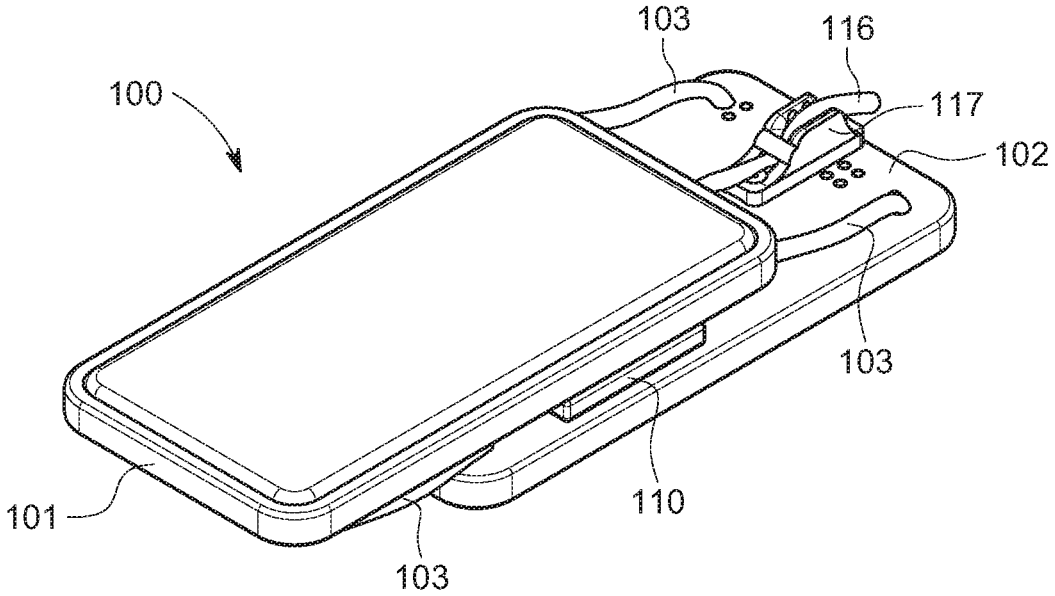
FIG. 8 is a perspective top, front view of the device of FIG. 1 in a closed configuration.
Figure 9:
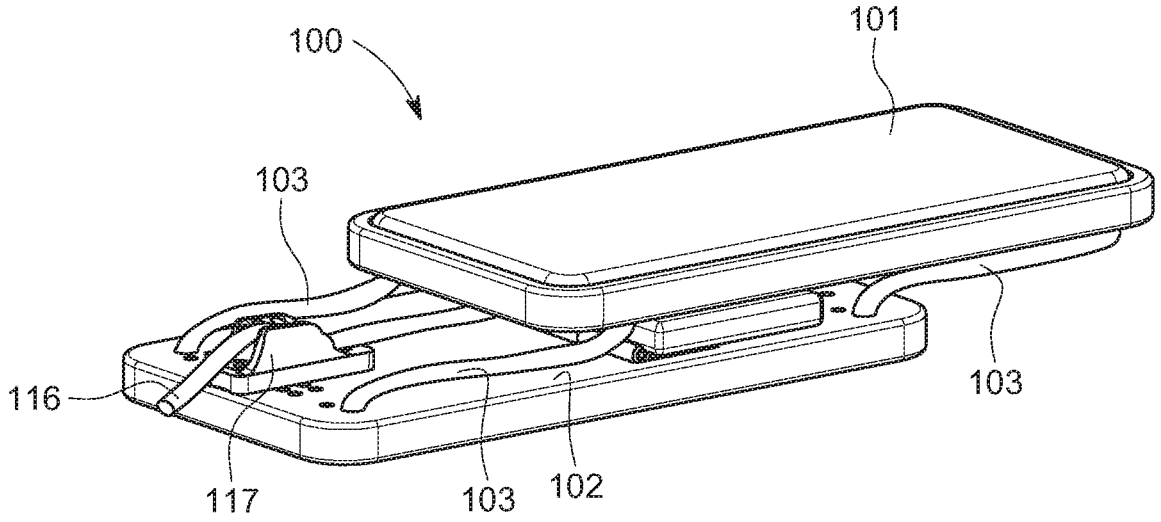
FIG. 9 is a perspective side, back view of the device of FIG. 1 in the closed configuration.
Figure 10:
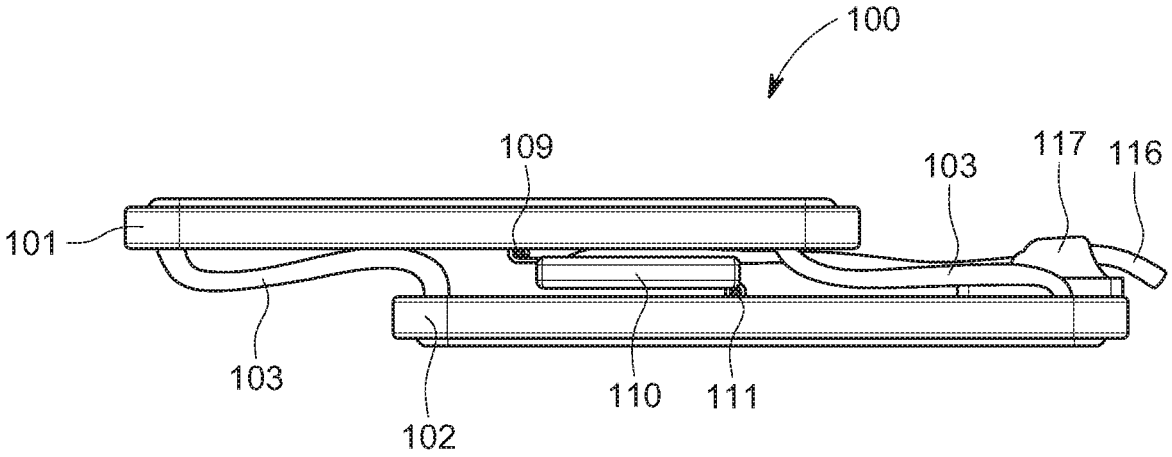
FIG. 10 is a side view of the device of FIG. 1 in the closed configuration.
Figure 11:
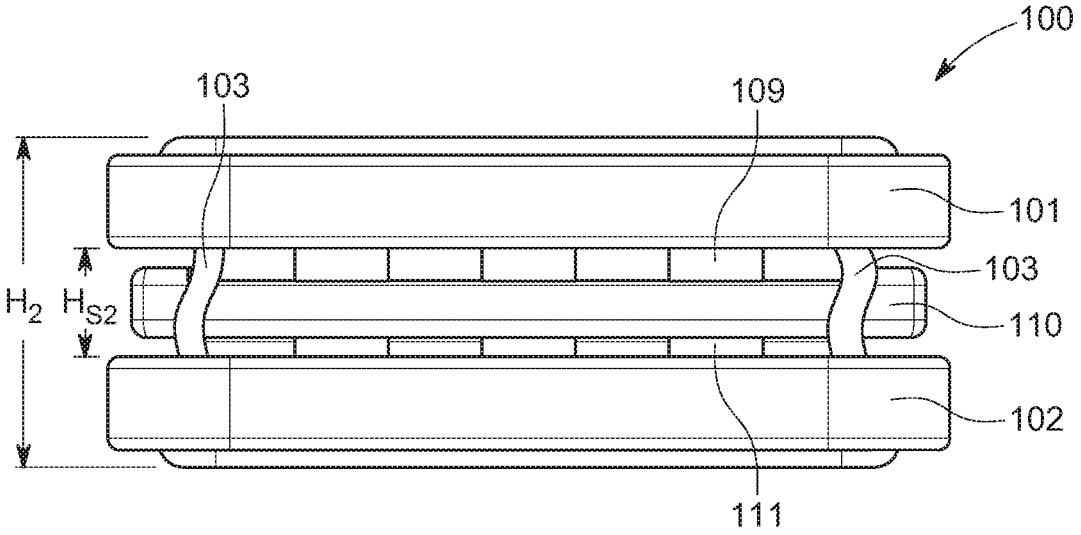
FIG. 11 is a front view of the device of FIG. 1 in the closed configuration.
Figure 12:
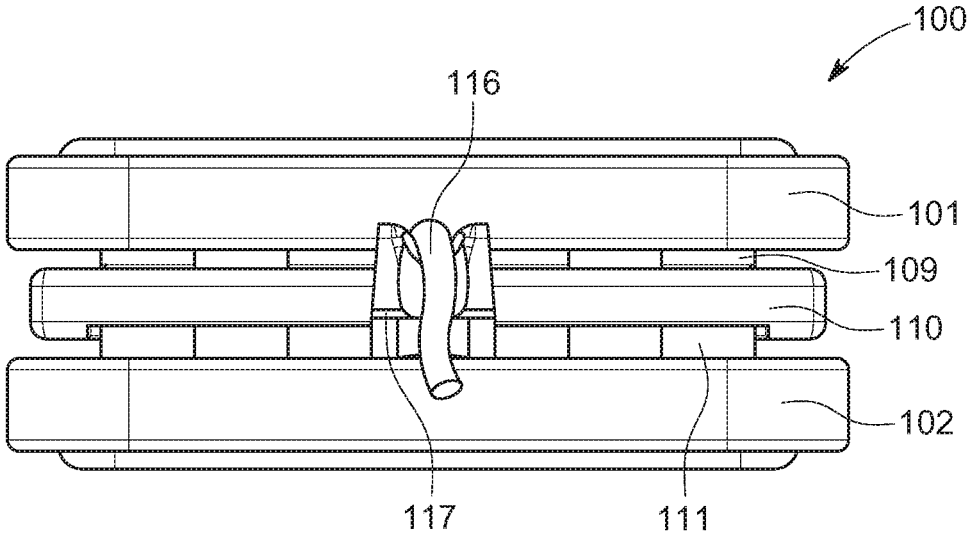
FIG. 12 is a back view of the device of FIG. 1 in the closed configuration.

As illustrated in FIGS. 1-12, the pedal 101 can be shaped to receive a user's foot, for example, the foot 121 of the user 123 (see FIGS. 6 and 7). In one exemplary embodiment, for example, the pedal 101 comprises a substantially flat, rectangular body 107 configured to receive the foot 121 of the user 123. In other exemplary embodiments, as illustrated in the embodiments of FIGS. 22-27, the pedal may comprise a more contoured shape that loosely resembles the shape of a foot. The pedal 101 can be sized to accommodate a range of foot and/or shoe sizes. In various exemplary embodiments of the present disclosure, for example, the pedal 101 can have a length $L_P$ (see FIG. 3) ranging from about 8 inches to about 15 inches, for example from about 9 inches to about 10 inches, and a width WP (see FIG. 4) ranging from about 2 inches to about 7 inches, for example, about 4 inches to about 5 inches.

As discussed above, the pedal 101 includes a toe end portion 104, a heel end portion 105, and a foot surface 150 extending between the toe end portion 104 and the heel end portion 105. The foot surface 150 may include, for example, various ridges, treads (see, e.g., foot surface 550 of portable exercise device 500 of FIGS. 18-21), coatings, applied surfaces (e.g., grip tape), laser markings, and/or other mechanisms to increase user comfort and/or to increase friction on the foot surface 150 with which the foot comes into contact, for example, to massage the user's foot and/or prevent the foot from slipping on the foot surface 150. Massage of the user's foot, via the foot surface 150 and any elements, coatings, or surfaces applied thereto, will apply pressure to the sole of the foot during the exercise, i.e., plantar pressure, which also contributes to movement of fluid through the body tissue and to an increase in circulation of bodily fluids.

In various embodiments, the foot surface 150 may include a removable pad upon which the foot may rest for comfort and/or additional support. Additionally or alternatively, the pad may be made from a soft, form fitting material, such as, for example, a shape memory polymer, which may conform to the feet of different users, as would be understood by those of ordinary skill in the art. In various additional embodiments, to simplify the device 100, grip tape and/or laser markings may be applied directly to the foot surface 150.

The pedal 101, and the foot surface 150 of the pedal 101, may have various sizes (i.e., dimensions), shapes, configurations and/or features without departing from the scope of the present disclosure. In various embodiments, for example, a foot guide can be placed on the foot surface 150 to assist in the proper placement of a user's foot on the pedal 101. The foot guide may include, for example, a movable guide and/or a printed outline that is representative of several general foot size categories. In various further embodiments, the pedal may also be extensible to accommodate various foot/shoe sizes. For example, the pedal may be extensible such that both ends of the pedal are configured to move away from a center of the pedal a corresponding distance, to maintain a central position of the pivot axis and maintain stability of the device.

The base 102 may be formed from any material and/or combination of materials suitable for mounting the pedal 101 and stably supporting the device 100 relative to the support surface 160 while the user is using the device 100 in accordance with the present disclosure. In various exemplary embodiments, the base 102 may, for example, comprise a molded plastic material, such as, for example, a molded polypropylene material. Those of ordinary skill in the art will understand, however, that the base 102 may be made of various plastic materials, as well as various other materials, including, for example, wood and/or metal materials, as described further below. Suitable materials can include, for example, materials that are relatively light to facilitate carrying, packing, and transporting the device 100, yet durable and able to withstand repetitive use.

As shown in FIGS. 1-12, in one exemplary embodiment of the present disclosure, the base 102 comprises a substantially flat, rectangular body 107 provided with a bottom surface 140 that is configured to rest against a support surface 160, while the user 123 is using the device 100 (see FIGS. 6 and 7). The base 102 is appropriately sized and/or configured to stably support the pedal 101 (e.g., against the support surface 160), when the exercise device 100 is in use. The body 106 of the pedal 101 and the body 107 of the base 102 have similar dimensions such that, when the device 100 is in the open configuration, and the pedal 101 is positioned to receive the foot 121 of the user 123 (see FIGS. 6 and 7), the pedal 101 is substantially parallel to the base 102 and respective corners of the bodies 106 and 107 are substantially in alignment with each other. Thus, in various exemplary embodiments, like the pedal 101, the base 102 can have a length $L_B$ (see FIG. 3) ranging from about 8 inches to about 15 inches, for example from about 9 inches to about 10 inches, and a width $W_B$ (see FIG. 4) ranging from about 2 inches to about 7 inches, for example, about 4 inches to about 5 inches.

The base 102 may take on a variety of sizes, shapes, configurations and/or features without departing from the scope of the present disclosure. As illustrated in FIGS. 1-21, in some embodiments, for example, the base is solid, while in other embodiments, the base has cutouts (see, e.g., FIGS. 22-27) configured to reduce the weight of the base. Furthermore, in some embodiments, the bottom surface 140 of the base 102 may include various ridges, treads, coatings, applied surfaces, and/or other mechanisms to increase friction between the bottom surface 140 and the support surface 160 upon which the base 102 rests to prevent slippage of the base 102 on the support surface 160. In other embodiments, the base 102 may be configured to be secured to the support surface 160, via, for example, a bolt, screw, hook and loop material, and/or clamp.

In accordance with various embodiments, for example, to accommodate users in various positions, the device 100 may be used in both a sitting position (see FIG. 6) and a supine position (see FIG. 7). For example, as will be understood by those of ordinary skill in the art, the positioning of the device 100 can be adjusted such that the foot support portion 101 is disposed in a first position wherein the pedal 101 is in a neutral position N to receive a foot 121 of a user 123 in a sitting position (see FIG. 6) and a second position wherein the pedal 101 is in the neutral position N to receive a foot 121 of a user 123 in a supine position (see FIG. 7). In one example, to better support use in the supine position, the bottom surface 140 of the base 102 may be secured to a vertical support surface 160, such as, for example, a backboard 160 of a bed surface 170, as illustrated in FIG. 7.

As illustrated in FIGS. 6 and 7, in such embodiments (e.g., wherein the device 100 is secured to the support surface 160), the device 100 may further comprise at least one strap 130 affixed to the pedal 101, two straps 130 (i.e., a toe strap and a heel strap) being shown in the embodiment of FIGS. 6 and 7. The straps 130 may, for example, be configured to releasably secure the foot 121 of the user 123 to the pedal 101. The straps 130 can be adjustable to permit loosening and tightening of the straps 130 around a user's foot. By way of example only, the straps 130 may comprise hook and loop fasteners, such as, for example, Velcro®. Those of ordinary skill in the art will further understand that the straps 130 may comprise any type and/or configuration or mechanism to releasably secure a foot of the user to the pedal 101, including for example, snaps, buttons, ties, buckles, elastic bands and/or any combination thereof. As will also be understood by those of ordinary skill in the art, the presence of a strap or other securing means is optional and is not necessary for use of the device. In some embodiments, for the device to be functional while secured to a user's foot, the base of the device must be secured to the floor, ground, or other stable surface. Thus, in some embodiments and in certain environments, operation of the device without a securing means may be preferred.

In accordance with exemplary embodiments of the present disclosure, the pedal 101 is pivotably connected to the base 102 via at least one hinge. As illustrated best perhaps in the open configuration of FIGS. 1-7, in one exemplary embodiment, the pedal 101 is pivotably mounted to the base 102 via a double-hinged support. For example, as shown in FIGS. 1-7, a support 110 is positioned between a first hinge 109 and a second hinge 111, wherein the first hinge 109 is connected to the pedal 101 and the second hinge 111 is connected to the base 102. As shown, the support 110 may be connected to the pedal 101, via the hinge 109, substantially midway between the toe end portion 104 and the heel end portion 105 of the body 106 of pedal 101. The support 110 may also be mounted to the base 102, via the hinge 111, substantially midway between corresponding end portions of the body 107 of base 102. In this manner, the support 110 is configured to rotate, via the hinges 109 and 111, between an upright position (see FIGS. 1-7) and a collapsed position (see FIGS. 8-12), as will be explained further below. When the support 110 is positioned in the upright position, as illustrated in FIGS. 1-7, the support 110 extends between and substantially perpendicular to the parallel bodies 106 and 107 of the pedal 101 and the base 102, respectively, thereby creating a space S therebetween (see FIG. 3). In such a configuration, the pedal 101 can pivot, via the hinge 109, toward and away from the base 102, and can have a neutral position N relative to a pivot axis P (see FIG. 14).

Figure 13A:
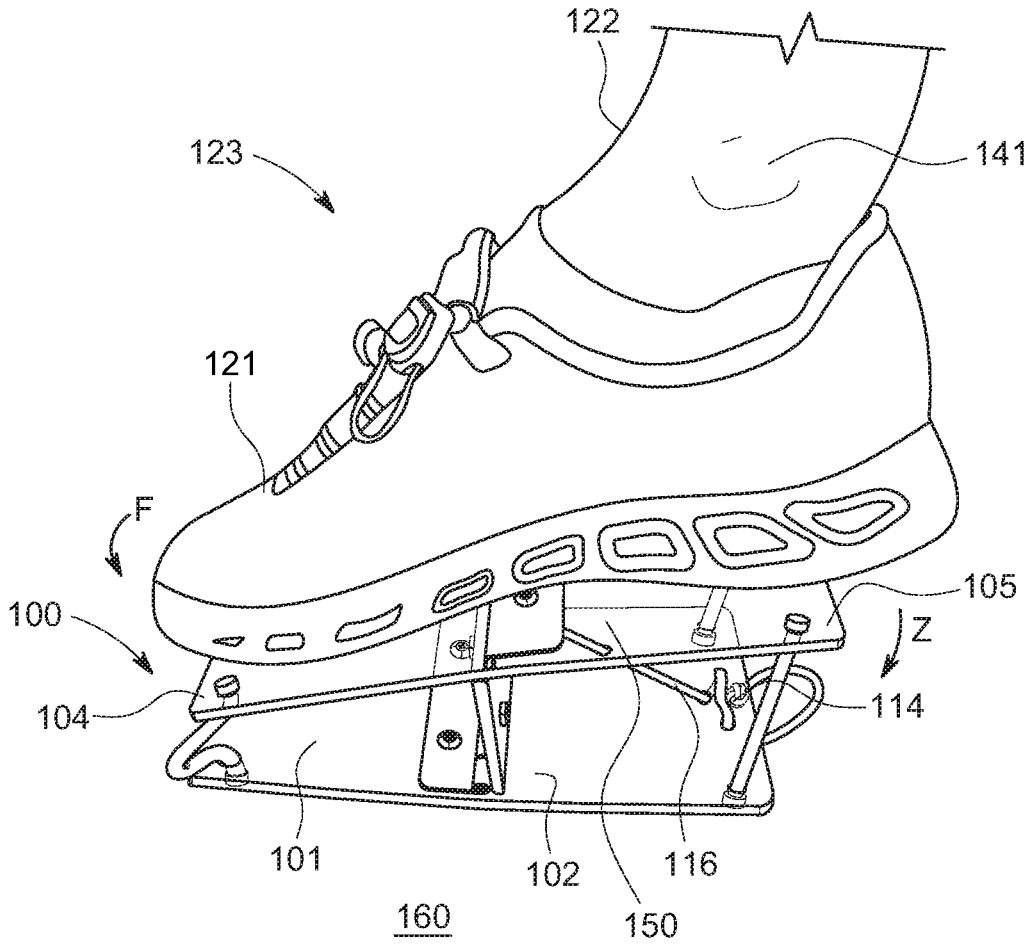
FIG. 13A is a perspective side view of another embodiment of a portable exercise device, in an open configuration, in accordance with the present disclosure, showing a user rotating a pedal of the device in a first direction.
Figure 13B:
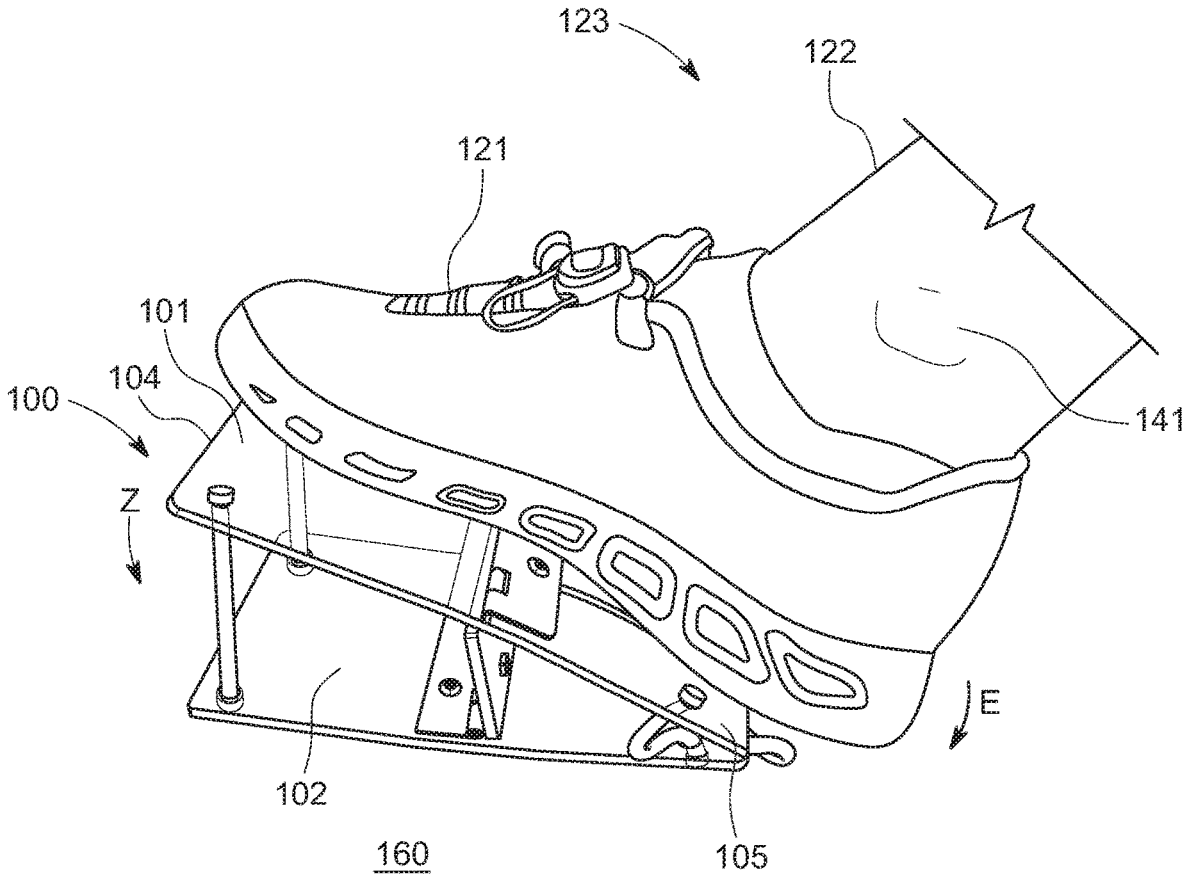
FIG. 13B is a perspective side view of the device of FIG. 12B in the open configuration, showing a user rotating a pedal of the device in a second direction.

As used herein, the term "neutral position" refers to a pedal starting position and a position of the pedal without external forces acting thereon to pivot the pedal about the pivot axis P (e.g., about the hinge 109). Thus, when a pedal is in the "neutral position," the foot of a user, which is received by the pedal, is in a relaxed, un-flexed position (i.e., the user's foot is neither extended or flexed). In the exemplary embodiment of FIGS. 1-7, in the "neutral position", the pedal 101 is substantially parallel to the base 102. With reference to FIGS. 13A, 13B, and 14, the pedal 101 is configured to rotate about the pivot axis P in a first direction away from the neutral position N and toward the base 102 and in a second direction away from the neutral position N and toward the base 102, wherein the second direction is opposite the first direction. For example, the pedal 101 is configured to undergo a rocking type motion in which the pedal 101 rotates about the pivot axis P in a first direction F away from the neutral position N (see FIG. 13A) in which the toe end portion 104 moves toward the base 102 (and the heel end portion 105 moves away from the base 102) and in a second direction E (see FIG. 13B) away from the neutral position N in which the heel end portion 105 moves toward the base 102 (and the toe end portion 104 moves away from the base 102). In this manner, rotation is around the axis P provided by the hinge 109 on the device 100, and, as illustrated in FIG. 14, the user's ankle 141 must pivot around this axis in an arc C. Consequently, the user's leg 122 must also move, in both an arc B and an arc C, to accommodate the rotation of the ankle 141 about the pivot P. For example, when the user 123 performs a plantarflexion motion, the ankle 141 rises, so the leg 122 must also rise. Similarly, when the user 123 performs a dorsiflexion motion, the ankle 141 lowers, so the leg 122 must also move lower.

The support 110 extending between the pedal 101 and the base 102 has a height h. When the device 100 is in the open, in use configuration, the pedal 101 and the base 102 are spaced apart from one another by the height h of the support 110. This space S has a height $H_{S1}$ when the device 100 is in the open configuration (see FIG. 3). The respective heights of the support 110 and the space S are configured to allow sufficient rotation of the pedal 101 in the first direction F about the pivot axis P (see FIG. 14) to subject a foot 121 of a user 123 to full flexion and to allow sufficient rotation of the pedal 101 in the second direction E about the pivot axis P (see FIG. 14) to subject the foot 121 of the user 123 to full extension. In various embodiments, for example, the space S may have a height $H_{S1}$ that is sufficient for the length of the pedal 101 to clear the base 102 when moved through 75 degrees of plantar flexion and 60 degrees of dorsiflexion. Those of ordinary skill in the art will understand that, to support the pedal 101 while also achieving the goal of full ankle flexion/extension, the support 110 may employ various pivoting mechanisms, and have various shapes, configurations and/or sizes (i.e., dimensions), including various heights h, which create various spaces S (i.e., having various heights $H_{S1}$) between the pedal 101 and the base 102, without departing from the scope of the present disclosure.

The resistance mechanism 103 is configured to exert a force on the pedal 101 about the pivot axis P in a direction opposite to a respective direction of rotation of the pedal 101 about the pivot axis P. In one exemplary embodiment, the resistance mechanism 103 comprises a plurality of elastomeric bands 103, each of the bands 103 extending between and connected to the pedal 101 and the base 102. For example, as illustrated in FIGS. 1-12, an elastomeric band 103 extends between each pair of aligned corners of the bodies 106 and 107 of the pedal 101 and the base 102. During rotation of the pedal 101, the elastomeric bands 103 exert a force on the pedal 101 about the pivot axis P in a direction opposite to the respective direction of rotation of the pedal 101 about the pivot axis P. For example, when a foot presses down on the toe end portion 104 or the heel end portion 105 of the pedal 101, the elastomeric bands 103 on the opposite side of the device 100 (i.e., opposite to the pressing action) extend, thereby exerting a force against the movement of the pedal 101. In other words, when a foot (e.g., toes of the foot) presses down on the toe end portion 104, thereby moving the toe end portion 104 of the pedal 101 toward the base 102, the elastomeric bands 103 connected to the heel end portion 105 are extended as the heel end portion 105 moves away from the base 102, thereby exerting a force that resists the movement of the heel end portion 105 away from the base and the toe end portion 104 toward the base. Likewise, when a foot (e.g., a heel of the foot) presses down on the heel end portion 105, thereby moving the heel end portion 105 of the pedal 101 toward the base 102, the elastomeric bands 103 connected to the toe end portion 104 are extended as the toe end portion 104 moves away from the base 102, thereby exerting a force that resists the movement of the toe end portion 104 away from the base and the heel end portion 105 toward the base.

Accordingly, in various exemplary embodiments of the present disclosure, the force exerted by the elastomeric bands 103 may provide passive resistance to rotational movement of the pedal 101 in both directions (i.e., F and E of FIG. 14) about the pivot axis P. And, in various additional embodiments, an amount of the force may vary with a degree of rotation θ (see FIG. 14) of the pedal 101 about the pivot axis P, for example, the amount of force may increase with the degree of rotation θ of the pedal 101 about the pivot axis P.

Furthermore, to change the amount of force or resistance exerted by the elastomeric bands 103, various additional embodiments of the present disclosure contemplate, for example, providing elastomeric bands 103 that are removable and/or reconfigurable, such that additional elastomeric bands 103 may be added to the device 100, in addition to and/or in exchange for existing elastomeric bands 103. In this manner, a user of the device 100 may increase and/or decrease the amount of force that is exerted by the elastomeric bands, to, for example, accommodate a user as strength increases or to otherwise scale up and/or down an exercise routine.

Those of ordinary skill in the art will understand that resistance mechanisms in accordance with the present disclosure may comprise various types, numbers, configurations, and/or combinations of elements that may exert a force on the pedal 101 about the pivot axis P in a direction opposite to the respective direction of rotation of the pedal 101 and are not limited in any way to elastomeric bands, or to the particular exemplary configuration of elastomeric bands 103 of the embodiment illustrated in FIGS. 1-12. Examples of resistance mechanisms other than elastomeric bands that can be used, or that can be used in combination with elastomeric bands, for example, at each respective end portion of the pedal 101, include but are not limited to, for example, springs (see, e.g., springs 203 in portable exercise device 200 of FIG. 15), inflatable devices (see, e.g., inflatable bags 303 in portable exercise device 300 of FIG. 16), bellows (see, e.g., bellows 403 in portable exercise device 400 of FIG. 17), and/or foams.

When such non-elastomeric resistance mechanisms are utilized (e.g., springs 203, inflatable bags 303, and/or bellows 403), the resistance mechanisms on the same side of the device 100 as the pressing action may assist in returning the pedal 101 to the neutral position. In other words, when the toe end portion 104 of the pedal 101 moves toward the base 102, the non-elastomeric resistance mechanisms connected to the toe end portion 104 may assist in returning the pedal 101 to the neutral position N; and when the heel end portion 105 of the pedal moves toward the base 102, the non-elastomeric resistance mechanisms connected to the heel end portion 105 may assist in returning the pedal 101 to the neutral position N. In various exemplary embodiments, the amount of assist respectively provided by the non-elastomeric resistance mechanisms on the pedal 101 is proportional to the amount by which the pedal 101 is rotated about the pivot axis P and away from the neutral position N.

Figure 22:
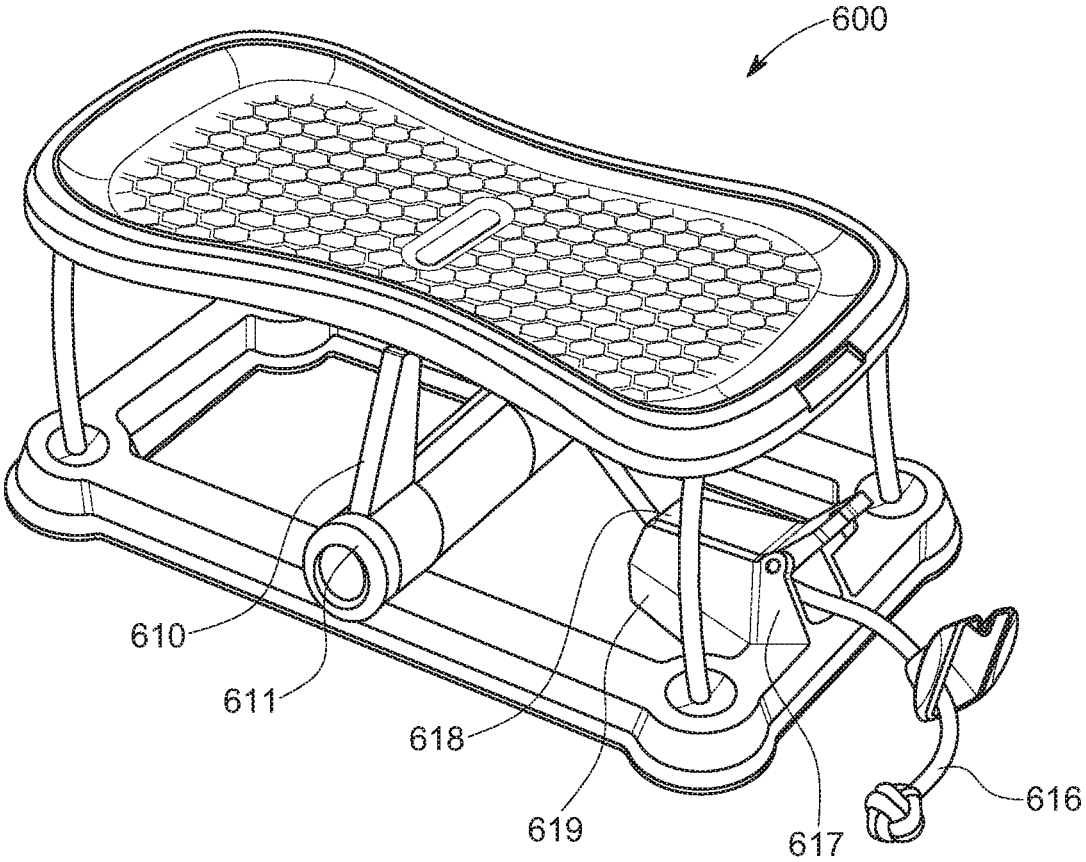
FIG. 22 is a perspective top, front view of another embodiment of a portable exercise device, in an open configuration, in accordance with the present disclosure.

Various additional exemplary embodiments further contemplate utilizing a resistance mechanism that is positioned at the pivot P, as disclosed, for example, in U.S. Provisional Application No. 62/635,165, entitled "Devices and Methods for Exercising an Ankle, Foot, and/or Leg" and filed on Feb. 26, 2018, the entire contents of which are incorporated by reference herein. Such resistance mechanisms may include, for example, but are not limited to friction devices, torsion bars, spring devices (e.g., torsion springs/linear springs), detent dials, adjustable clutch mechanisms, piezoelectric/nanomotion motors, pneumatic, and/or hydraulic devices, such as, for example, hydraulic cylinders (see below), viscous damping devices, and/or devices utilizing smart fluids, such as, for example, magnetorheological fluids or electrorheological fluids. As illustrated in FIG. 22, for example, various exemplary embodiments of the present disclosure contemplate a portable exercise device 600, which includes molded hinges 609 (not shown in the view of FIGS. 22) and 611 that are integral with a collapsible support 610. The collapsible support 610 may, for example, be made from a molded plastic material with the hinges 609 and 611 and/or locking mechanisms molded into it. In such a configuration, the molded hinge 609 could also house an adjustable resistance mechanism, such as, for example, one of the resistance mechanisms disclosed in U.S. Provisional Application No. 62/635,165. The resistance mechanisms and the respective ranges of resistance for the resistance mechanisms disclosed in U.S. Provisional Application No. 62/635,165 are incorporated herein by reference.

For portability, the device 100 is adjustable between at least two configurations. As shown in FIGS. 1-7, the device 100 may be adjusted to an open configuration wherein the pedal 101 is disposed in the neutral position N to receive a foot 121 of a user 123. Alternatively, as shown in FIGS. 8-12, the device 100 may be adjusted to a closed configuration wherein the pedal 101 is collapsed against the base 102 to minimize the space S between the pedal 101 and the base 102, thereby minimizing the profile of the device 100 for ease of transport. Thus, as discussed above, the device 100 includes a collapsible support 110 that is configured to rotate, via hinges 109 and 111, between an upright position in which the support 110 is perpendicular to the parallel bodies 106, 107 of the pedal 101 and the base 102 (see FIGS. 1-7) and a collapsed position in which the support 110 is parallel to the parallel bodies 106, 107 of the pedal 101 and the base 102 (see FIGS. 8-12). In this manner, the device 100 may be transitioned between the open and closed configuration via moving the support 110 between the upright and collapsed position, for example, by raising and lowering the support 110 with respect to the base 102 via the hinges 109 and 111.

Those of ordinary skill in the art will understand that embodiments of the present disclosure contemplate various mechanisms, which include various configurations of features, for transitioning the device 100 between the open and closed configurations, and are not limited in any way to the collapsible support 110 of the embodiment illustrated in FIGS. 1-12. Furthermore, the collapsible support 110 may be used in combination with various mechanisms to increase the stability of the device 100, when the device is in the open configuration. In various embodiments, for example, as illustrated in the embodiment of FIGS. 18-21, the device may further include a block that is secured to the base, against which the collapsible support may rest when in the open configuration.

In accordance with various embodiments of the present disclosure, the device 100 may include, for example, a closure mechanism 115 that is configured to transition the device 100 between the open and closed configurations. In various exemplary embodiments, the closure mechanism 115 includes a cord 116 and a clamp 117, such as, for example, a v-clamp 117. As illustrated in the embodiment of FIGS. 1-12, the clamp 117 is mounted to an end portion of the base 102, on a top surface 145 of the base 102. And, the cord 116 is configured to extend between the support 110 and the clamp 117. In various exemplary embodiments, the cord 116 is affixed to the support 110 at a location adjacent to the pedal 101, such as, for example, at a location of the hinge 109 connecting the support 110 to the pedal 101. As shown best perhaps in FIGS. 3-5, a first end of the cord 116 may be, for example, threaded through a hole 119 in the hinge 109/support 110 and knotted on the opposite side of the support 110, while a second end of the cord 116 is threaded through the clamp 117. In this manner, the support 110 may be raised and lowered with respect to the base 102 (i.e., transitioned between the upright and collapsed configurations) by respectively securing and releasing the cord 116 within the clamp 117. In other words, to raise the support 110 and maintain (lock) the support 110 in the upright configuration, the cord 116 may be pulled taut and secured within the clamp 117. And, to lower the support 110 the cord 116 may be released from the clamp 117, such that the cord 116 is slackened to allow the support 110 to collapse against the top surface 145 of the base 102 via the hinges 109 and 111.

Those of ordinary skill in the art will understand that devices in accordance with the present disclosure may comprise various types, numbers, configurations, and/or combinations of closure mechanisms to transition the device between the open configuration and the closed configuration and are not limited in any way to the cord and clamp mechanism of the embodiment illustrated in FIGS. 1-12. As illustrated in the embodiment of FIG. 22, for example, one embodiment of the present disclosure contemplates a device 600 that utilizes a plastic clamp 617 to lock the device 600 in the open configuration. The clamp 617 may include, for example, an upper jaw 618 that pivots with respect to a lower jaw 619, such that the upper jaw 618 may clamp down on a cord 616 that runs between the jaws 618 and 619. As illustrated in the embodiment of FIGS. 13A and 13B, for example, various additional embodiments of the present disclosure contemplate that the device 100 utilizes a cord 116 that interconnects directly with the base 102, such as, for example, with a notch 114 or other feature of the base 102. In various additional embodiments, the device may utilize a cord that has a ball at one end (see e.g., cord 516, having a ball 560, of portable exercise device 500 of FIGS. 18-21) to prevent the cord from sliding through the clamp. In various further exemplary embodiments, the device 100 may utilize a bar that is raised and lowered with respect to the support 110 to lock the support in the open configuration (e.g., similar to a kick stand as illustrated in the exemplary embodiment of FIGS. 34 and 35).

As illustrated in FIGS. 8-12, in the closed configuration of the device 100, the pedal 101 is collapsed against the base 102, reducing the space S between the pedal 101 and the base 102, such that the device 100 has a minimized profile. In this configuration, the support 110 is in a collapsed position in which the support 110 is parallel to the parallel bodies 106, 107 of the pedal 101 and the base 102. In other words, in the closed configuration of the device 100, the cord 116 of the closure mechanism 115 is slack such that the pedal 101 and support 110 can pivot, via the hinges 109 and 111, to collapse and lay flat against the base 102. Consequently, in this configuration, the elastomeric bands 103 are also substantially slack and collapsed with respect to the base 102, as further illustrated in FIGS. 8-12.

In accordance with various exemplary embodiments, in the closed configuration of the device 100, the space S between the pedal 101 and the base 102 is minimized such that a height $H_{S2}$ of the space S is less than the height $H_{S1}$ of the space S when the device 100 is in the open configuration. Consequently, in the closed configuration of the device 100, an overall height of the device 100 is also reduced. In various embodiments, for example, an overall height $H_1$ of the device 100 in the open configuration (see FIG. 3) ranges from about 3 inches to about 5 inches, while an overall height $H_2$ (see FIG. 10) of the device in the closed configuration ranges from about 1 inches to about 3 inches.

Figure 27:
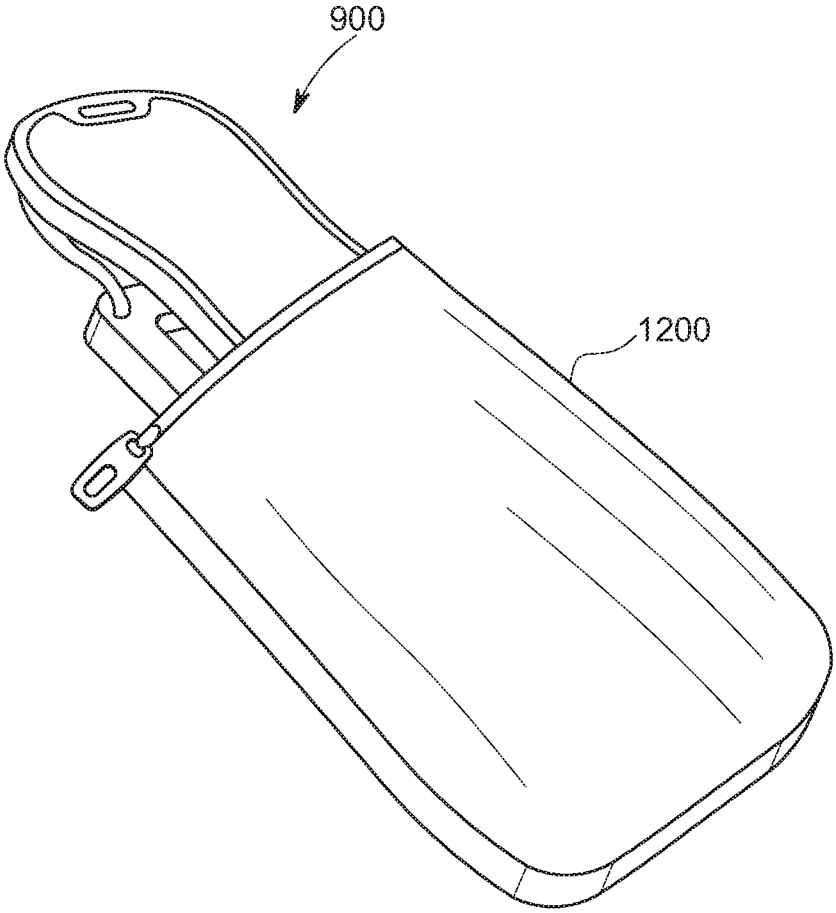
FIG. 27 is a top, front view of the device of FIG. 25 in a closed configuration and partially inserted into an exemplary pouch in accordance with the present disclosure.
Figure 28:
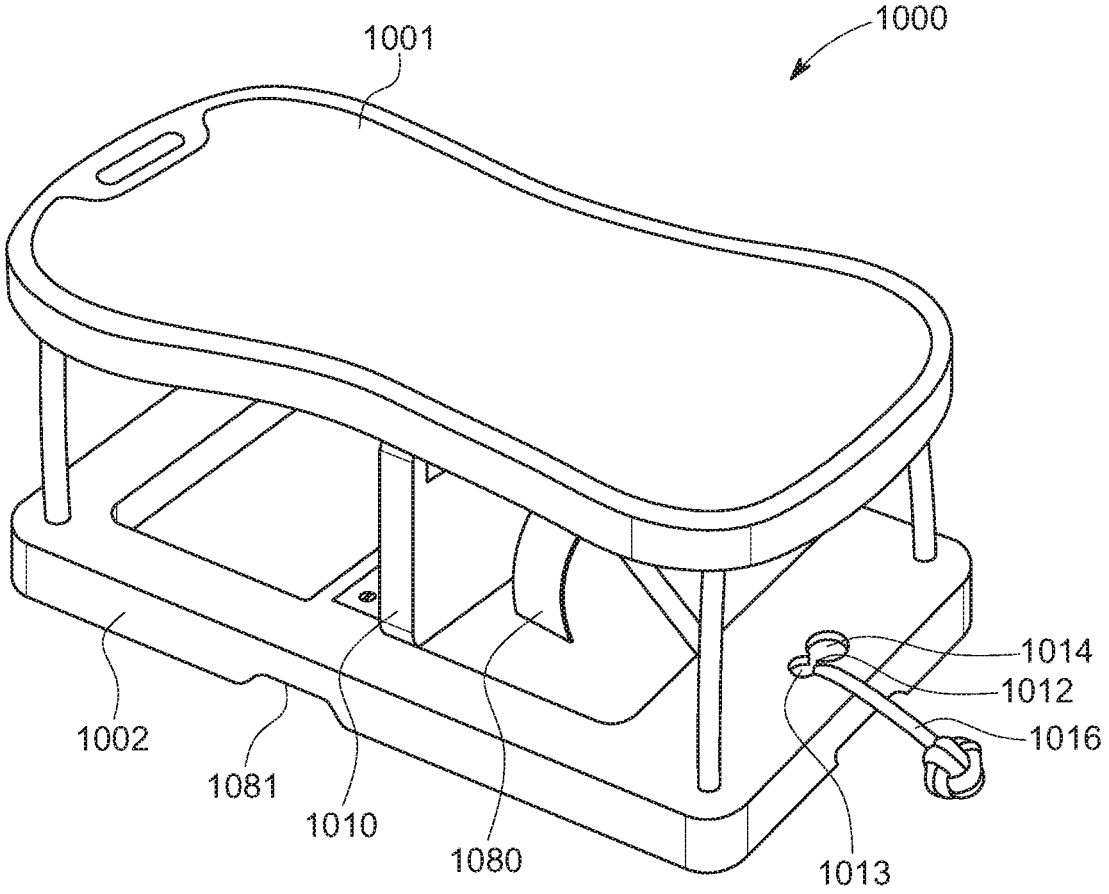
FIG. 28 is a perspective top, front view of another embodiment of a portable exercise device, in an open configuration, in accordance with the present disclosure.
Figure 29:
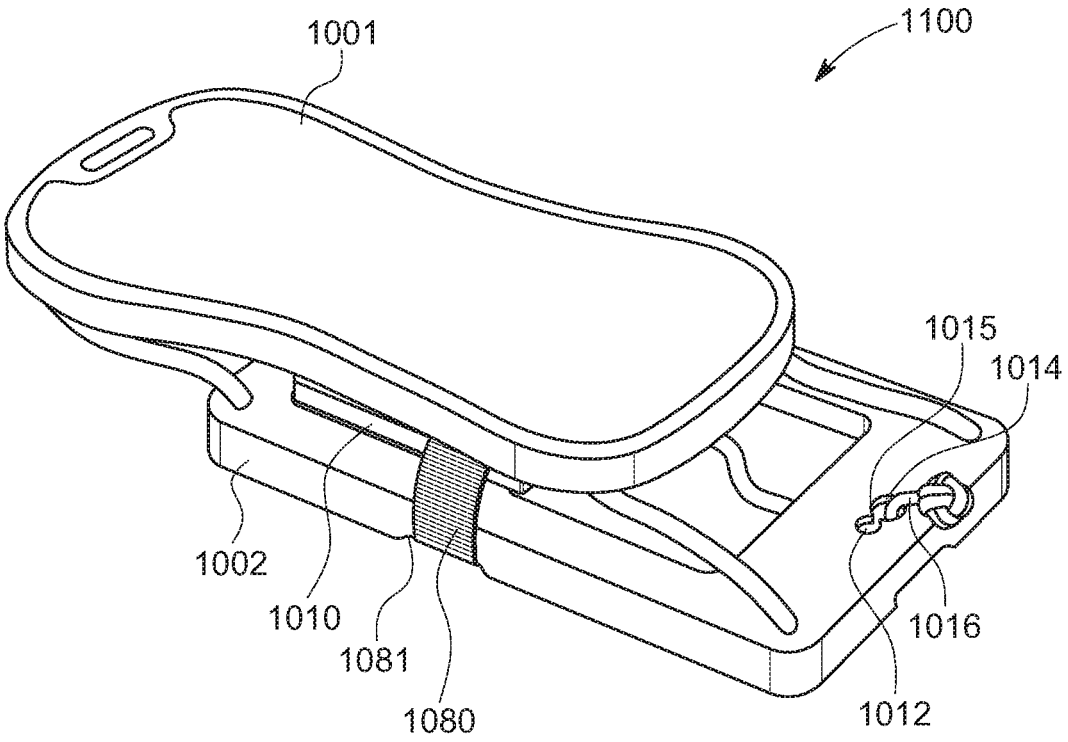
FIG. 29 is a perspective top, front view of the device of FIG. 28 in a closed configuration.
Figure 30:
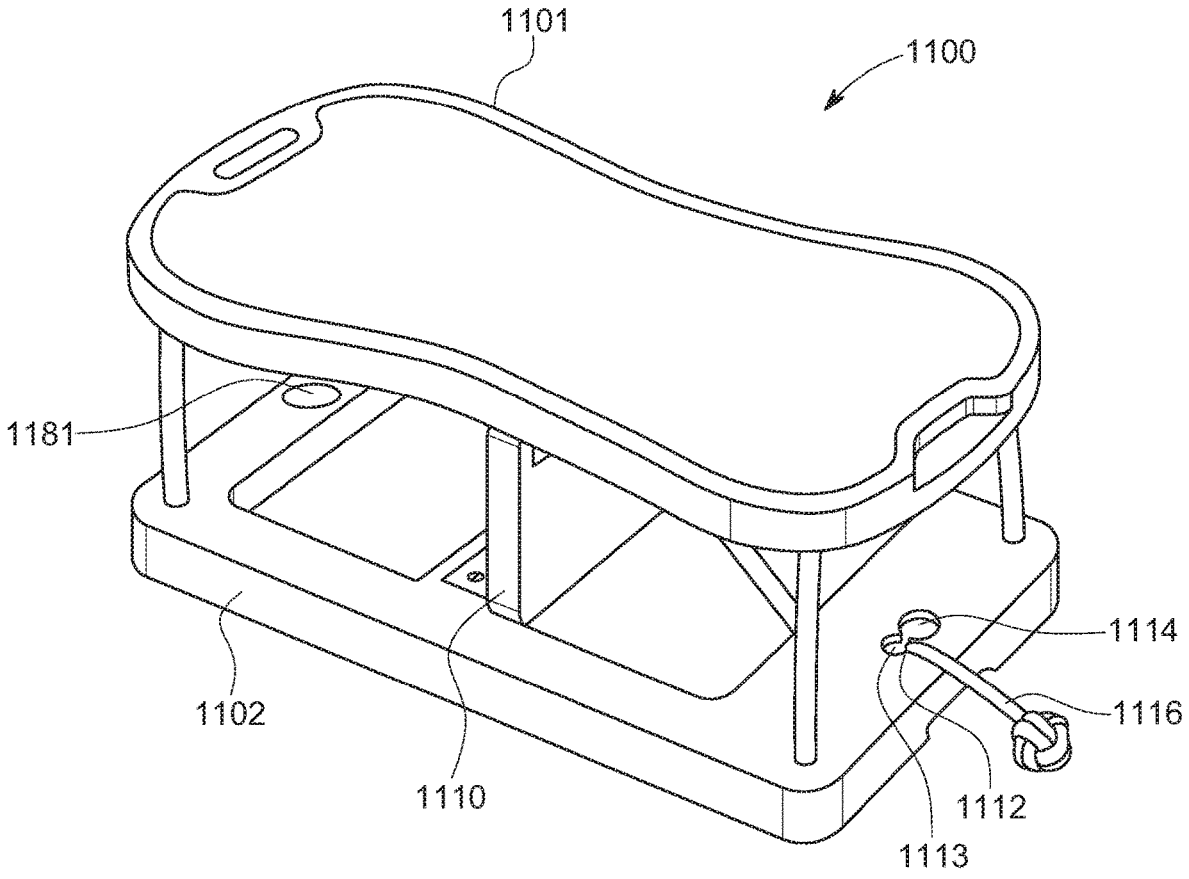
FIG. 30 is a perspective top, front view of another embodiment of a portable exercise device, in an open configuration, in accordance with the present disclosure.
Figure 31:
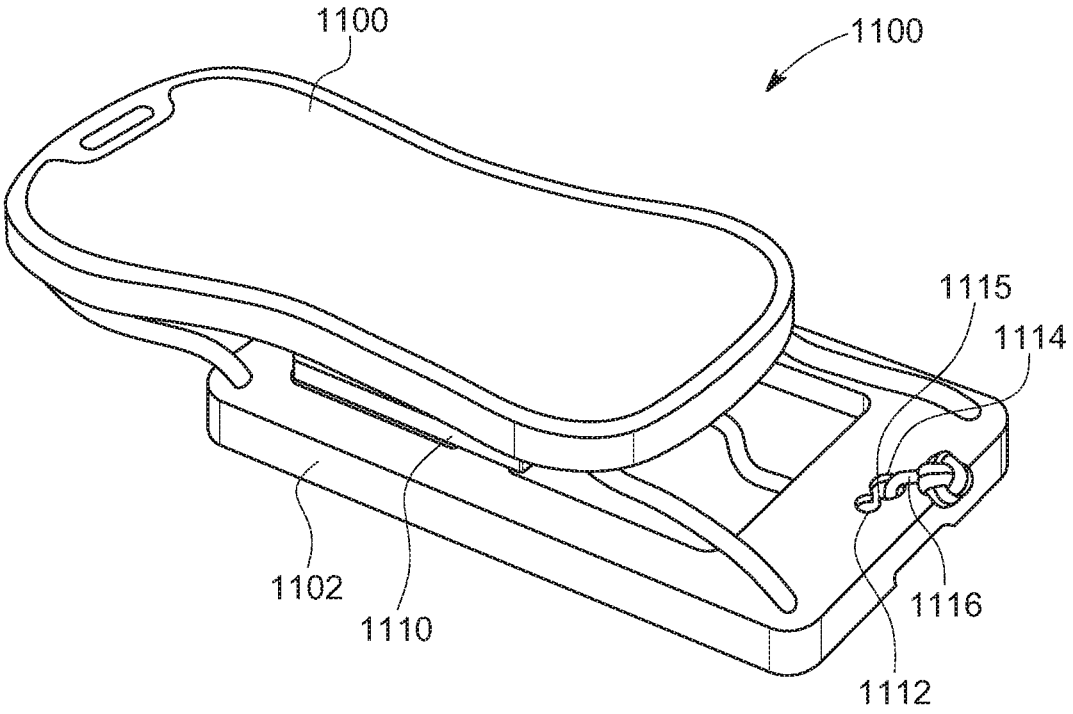
FIG. 31 is a perspective top, front view of the device of FIG. 30 in a closed configuration.

To help keep the device in the closed configuration, various embodiments of the present disclosure may also include a restraint. One exemplary embodiment may include a tie mechanism, such as, for example, a band (see, e.g., band 580 of portable exercise device 500 of FIG. 21) that is tied around the device to secure the collapsed pedal to the base. Another exemplary embodiment may include a pair of components configured to fit together in a tight manner such as in a press-fit or snap fit manner (see, e.g., components 980 and 981 of portable exercise device 900 of FIGS. 25 and 26) and that lock together when the device is in the closed configuration to secure the collapsed pedal to the base (see FIG. 26). In the exemplary embodiment, the elements comprise projection 981 and hole 980 that fit together in a press-fit or snap-fit manner. However, as will be apparent to those of ordinary skill in the art, it is possible that other configurations of objects to be connected in a press-fit or snap-fit manner may be used. For example, nesting objects which fit together in a press-fit or snap-fit manner may be used. Another exemplary embodiment may include a strap, such as, for example, a Velcro® strap that is connected to the pedal and configured to attach, for example, to a loop material on a bottom surface of the base (see, e.g., strap 1080 and material 1081 of portable exercise device 1000 of FIGS. 28 and 29) when the pedal is collapsed against the base (see FIG. 29). Another exemplary embodiment may include a magnet on a top surface of the base (see, e.g., magnet 1181 of portable exercise device 1100 of FIGS. 30 and 31) that is configured to attach to a corresponding magnet on a bottom surface of the pedal (not shown in the view of FIG. 30) when the pedal is collapsed against the base (see FIG. 31). Those of ordinary skill in the art will understand that devices in accordance with the present disclosure may comprise various types, numbers, configurations, and/or combinations of restraint mechanisms to help keep the device in the closed configuration and are not limited in any way to the components illustrated in FIGS. 21, 25, 26, and 28-31. Those of ordinary skill in the art will further understand that devices in accordance with the present disclosure may be used in conjunction with various accessory devices, for example, in which to store the device when the device is locked in the closed configuration. As illustrated in FIG. 27, for example, various embodiments of the present disclosure contemplate portable exercise devices that, when locked in the closed configuration, are stored within a sleeve, such as, for example, a cloth or neoprene sleeve (see, e.g., sleeve 1200 of FIG. 27). A storage sleeve may, for example, provide both function and aesthetics. The sleeve may (1) protect the device from damage, (2) contain dirt and other contaminants the device may pick up during use, (3) aid in the carrying of the device, and (4) provide an aesthetic means of transporting and storing the device.

Figure 34:
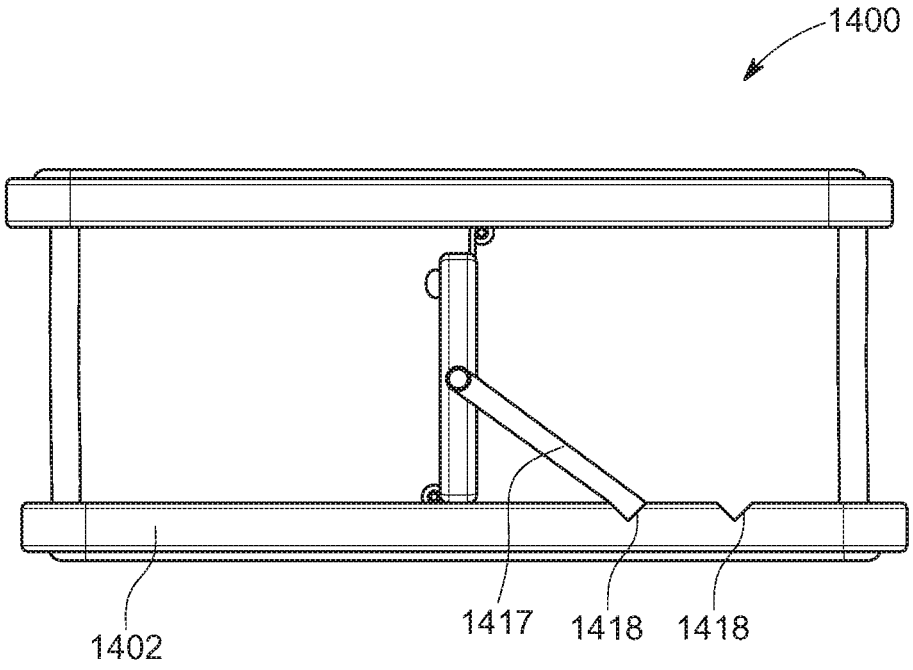
FIG. 34 is a side view of another exemplary embodiment of a portable exercise device, in an open configuration, in accordance with the present disclosure.
Figure 35:
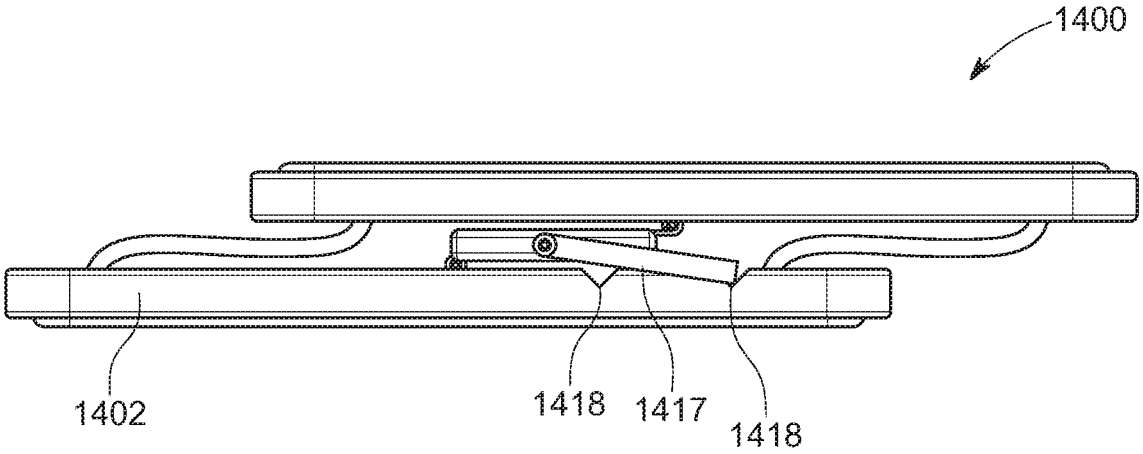
FIG. 35 is a side view of the device of FIG. 34 in a closed configuration.

Various additional embodiments of the present disclosure contemplate utilizing a single locking mechanism that functions to both (1) lock the device in the open configuration for use, and (2) lock the device in the closed configuration for storage. In one embodiment, such a locking mechanism may function, for example, similar to the conventional locking mechanism utilized by folding tables, in which the support includes a sliding arm that is spring-loaded on a pin. As will be understood by those of ordinary skill in the art, as the sliding arm gets pushed out (i.e., to open the device) and in (i.e., to close the device), the arm may slide back and forth along the pin (i.e., via a slot/track in the center of the arm). And, at either end of the track (i.e., when the device is fully open or fully closed), the arm pops out of the track and locks into place. To change the configuration of the device, the user then depresses the pin to unlock the device and move the pin back into the track. In accordance with various additional exemplary embodiments, as illustrated in FIGS. 34 and 35, an exercise device 1400 may include a similar locking mechanism comprising an arm 1417 that is configured to lock into place, in either an open configuration (see FIG. 34) or a closed configuration (see FIG. 35), for example, via notches 1418 in the base 1402 of the device 1400. In this manner, the arm 1417 functions like a kick stand that may lock into place in either an open or closed configuration. In still further exemplary embodiments, as illustrated in FIGS. 36-42 and described below, exercise devices 1500 and 1600 may each include a locking mechanism 1515, 1615 comprising a strap (e.g., a soft goods strap) 1516, 1616 that is used in conjunction with a hook (e.g., a G-hook) 1517, 1617 to lock the device 1500, 1600 into place, in either an open configuration (see FIGS. 36 and 40) or a closed configuration (see FIGS. 37-39 and FIGS. 41-42).

As described above, those of ordinary skill in the art will understand that the disclosed portable exercise devices, including the pedal and support, may be made of various materials, including, for example, various light weight wood materials, such as, for example, plywood, medium-density fiberboard (MDF), birch wood, and balsam wood. As above, such materials may be relatively light to facilitate carrying, packing, and transporting the device, yet durable enough to withstand repetitive use/motion. FIGS. 23-31 and 36-42, for example, illustrate several exemplary embodiments of portable exercises devices 700, 800, 900, 1000, 1100, 1500, and 1600 made from a light weight wood material.

Similar to the portable exercise device 100 described above, each of the devices 700, 800, 900, 1000, and 1100 includes a pedal 701, 801, 901, 1001, 1101; a base 702, 802, 902, 1002, 1102; and a collapsible support 710, 810, 910, 1010, 1110 connecting the pedal 701, 801, 901, 1001, 1101 to the base 702, 802, 902, 1002, 1102 (e.g., via hinges); such that the pedal 701, 801, 901, 1001, 1101 may be raised and lowered with respect to the base 702, 802, 902, 1002, 1102. Also similar to the portable exercise device 100, each of the devices 1500 and 1600 includes a pedal 1501, 1601 and a base 1502, 1602. In the exemplary embodiments of FIGS. 36-42, however, each base 1502, 1602 comprises of a pair of collapsible supports 1510*a*, 1610*a* and 1510*b*, 1610*b* that are connected to the pedal 1501, 1601 via a hinge 1509, 1609. In this manner, when the device 1500, 1600 is in the open configuration (see FIGS. 36 and 40), the supports 1510*a*, 1610*a* and 1510*b*, 1610 of the base 1502, 1602 form a triangular body that elevates the pedal 1501, 1601 with respect to the support surface. And, when the device 1500, 1600 is in the closed configuration (see FIGS. 37-39 and FIGS. 41-42), the supports 1510*a*, 1610*a* and 1510*b*, 1610 of the base 1502, 1602 fold (via the hinge 1509, 1609) flat against the pedal 1501, 1601.

Figure 37:
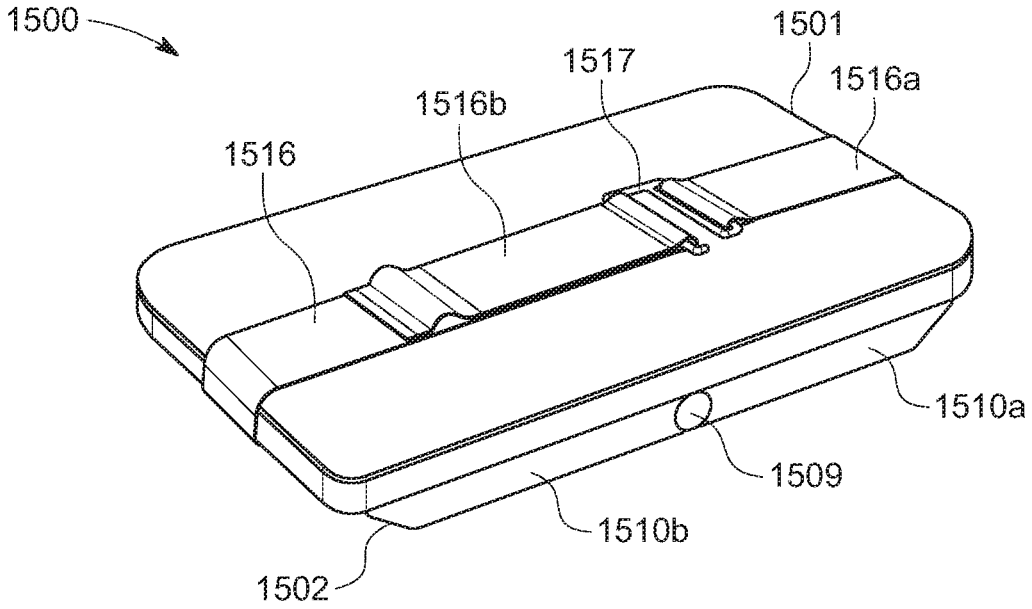
FIG. 37 is a perspective top, back view of the device of FIG. 36 in a closed configuration.
Figure 38:
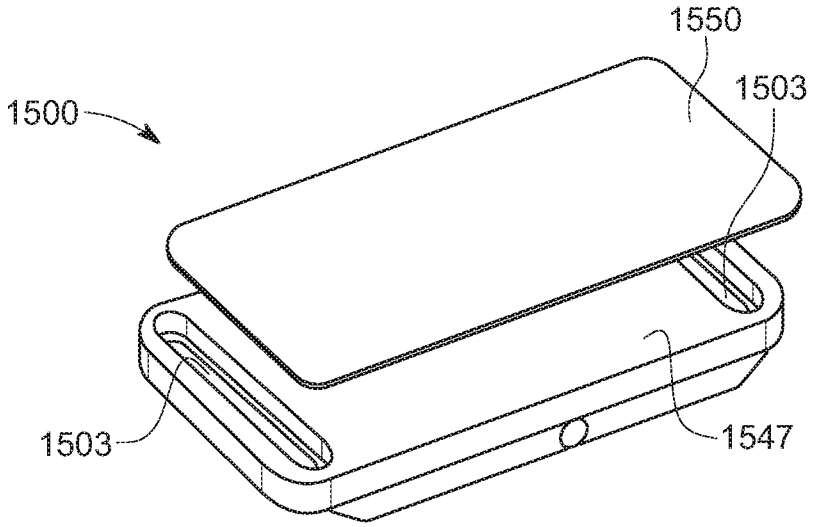
FIG. 38 is a partially exploded, perspective top, back view of the device of FIG. 36 in the closed configuration.
Figure 39:
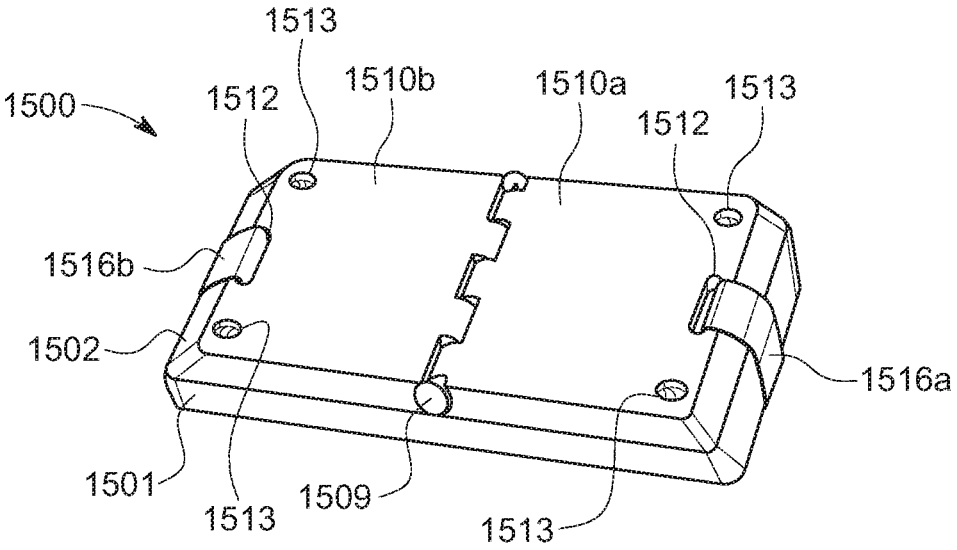
FIG. 39 is a perspective bottom view of the device of FIG. 36 in the closed configuration.

To both simplify and reduce the weight of the devices 700, 800, 900, 1000, 1100, 1500, 1600 in the present embodiments, these components are at least partly made from a wood material. In one embodiment, for example, the pedals 701, 801, 901, 1001, 1101 bases 702, 802, 902, 1002, 1102 and supports 710, 810, 910, 1010, 1110 are each made of plywood, such as, for example, a ¼ inch to a ⅜ inch plywood that is sanded and varnished to a smooth finish. In another embodiment, the pedal 1501 and the supports 1510*a* and 1510*b* are each made of MDF, with the pedal further including a birch top piece 1550. In yet another embodiment, the pedal 1601 is made of MDF with a birch top piece 1650, while the supports 1610*a* and 1610*b* are made of aluminum. In various embodiments, for example, the supports 1610*a* and 1610*b* include bent, hollow tubes. Furthermore, as illustrated in FIG. 38, in such embodiments, elastomeric bands 1503, 1603 of the resistance mechanism may be passed through an MDF support 1547, 1647 of the pedal 1501, 1601, which is covered by the birch top piece 1550, 1650, and connected to respective supports 1510*a*, 1610*a* and 1510*b*, 1610*b* (e.g., via holes 1513, 1613 (see, e.g., FIGS. 36 and 40) in the supports 1510*a*, 1610*a* and 1510*b*, 1610*b*). Those of ordinary skill in the art will understand that the wood embodiments depicted in FIGS. 23-31 and 36-42 are exemplary only and that any combination of wood/non-wood materials may be used.

Figure 23:
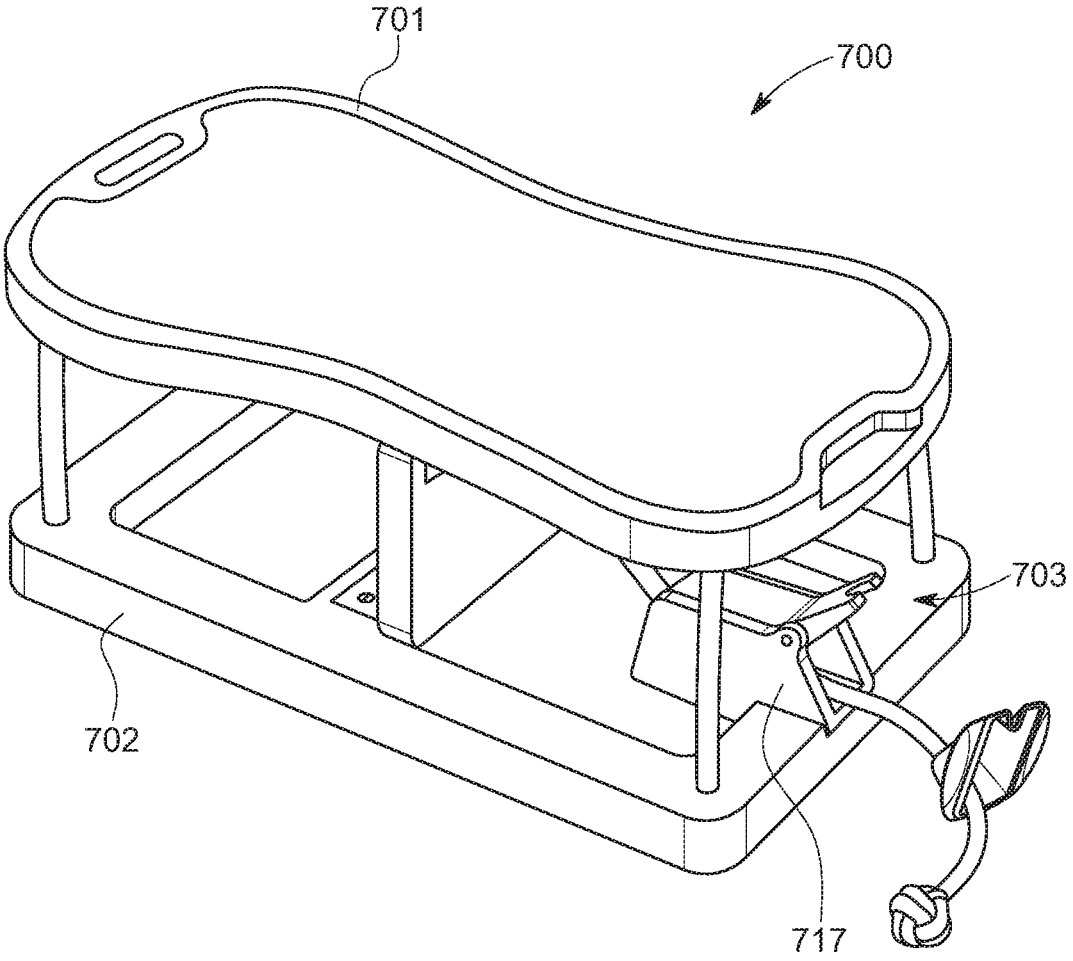
FIG. 23 is a perspective top, front view of yet another embodiment of a portable exercise device, in an open configuration, in accordance with the present disclosure.
Figure 24:
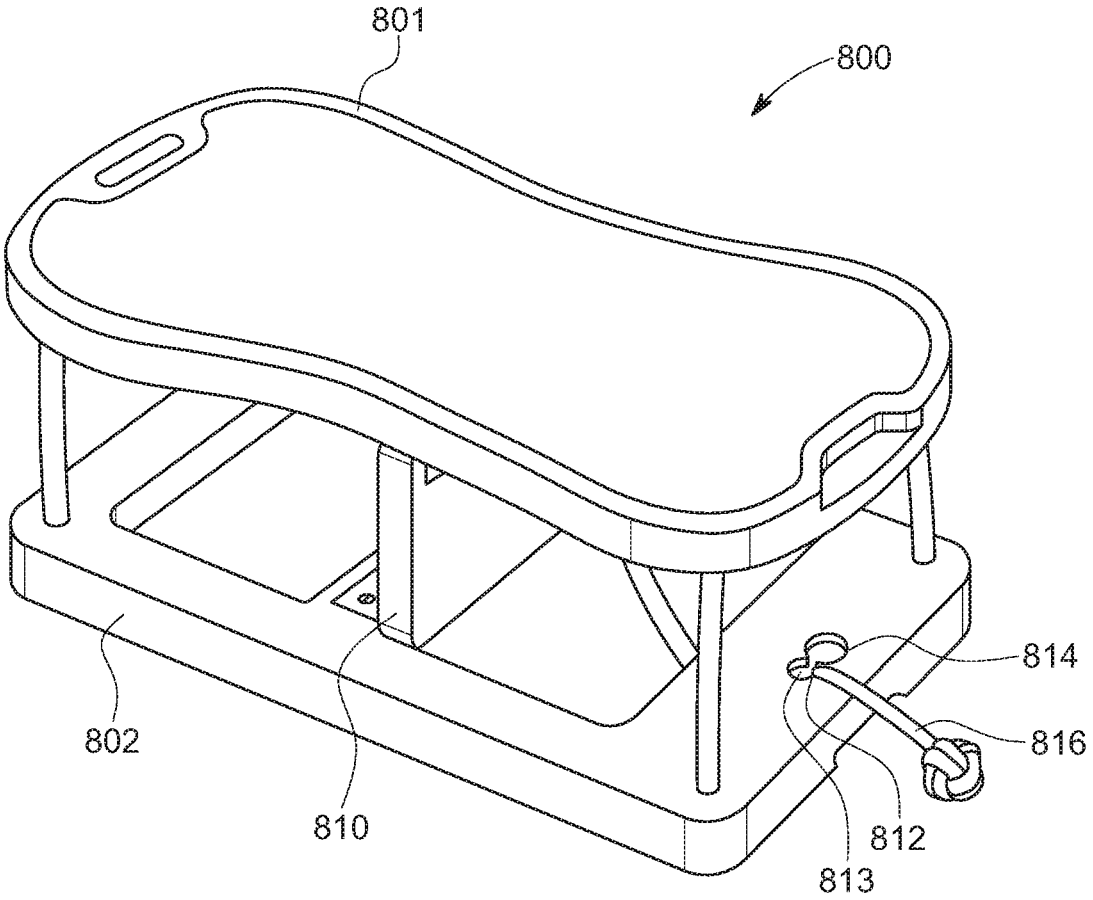
FIG. 24 is a perspective top, front view of an additional embodiment of a portable exercise device, in an open configuration, in accordance with the present disclosure.
Figure 25:
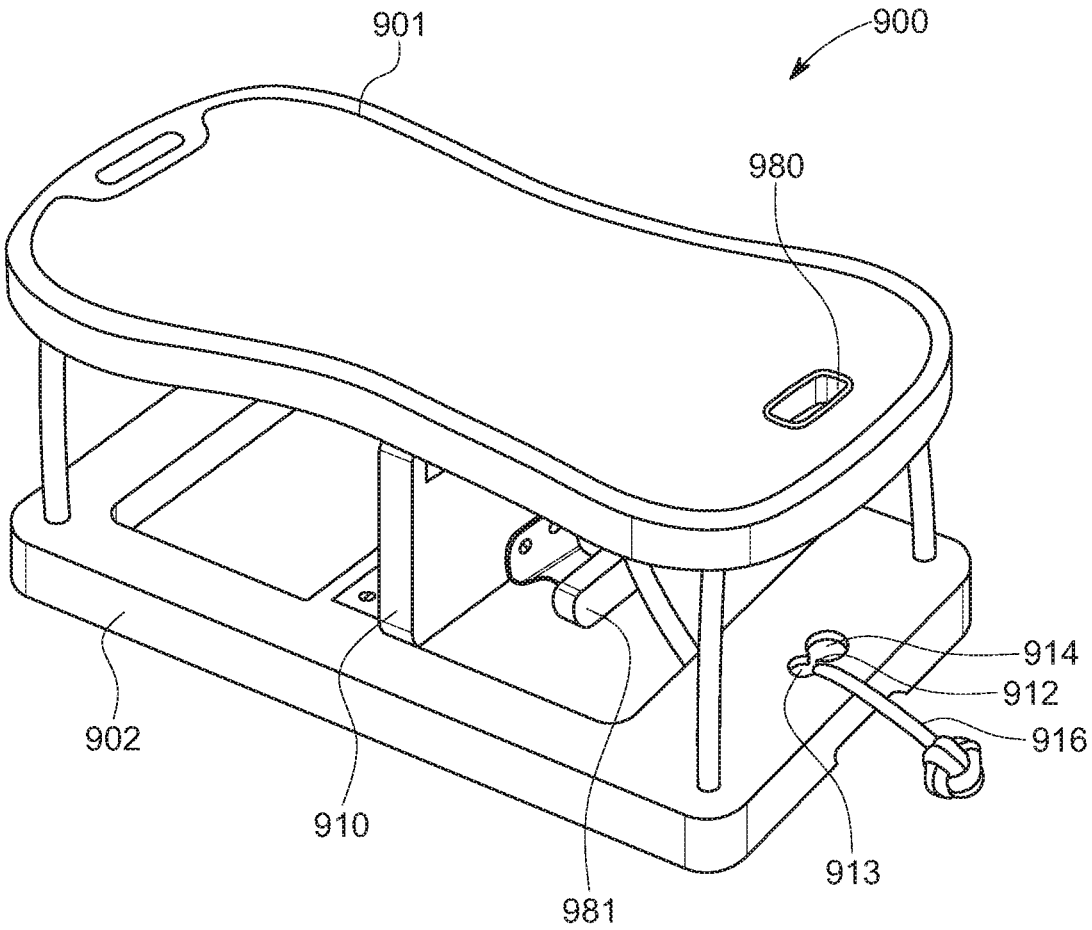
FIG. 25 is a perspective top, front view of another embodiment of a portable exercise device, in an open configuration, in accordance with the present disclosure.
Figure 26:
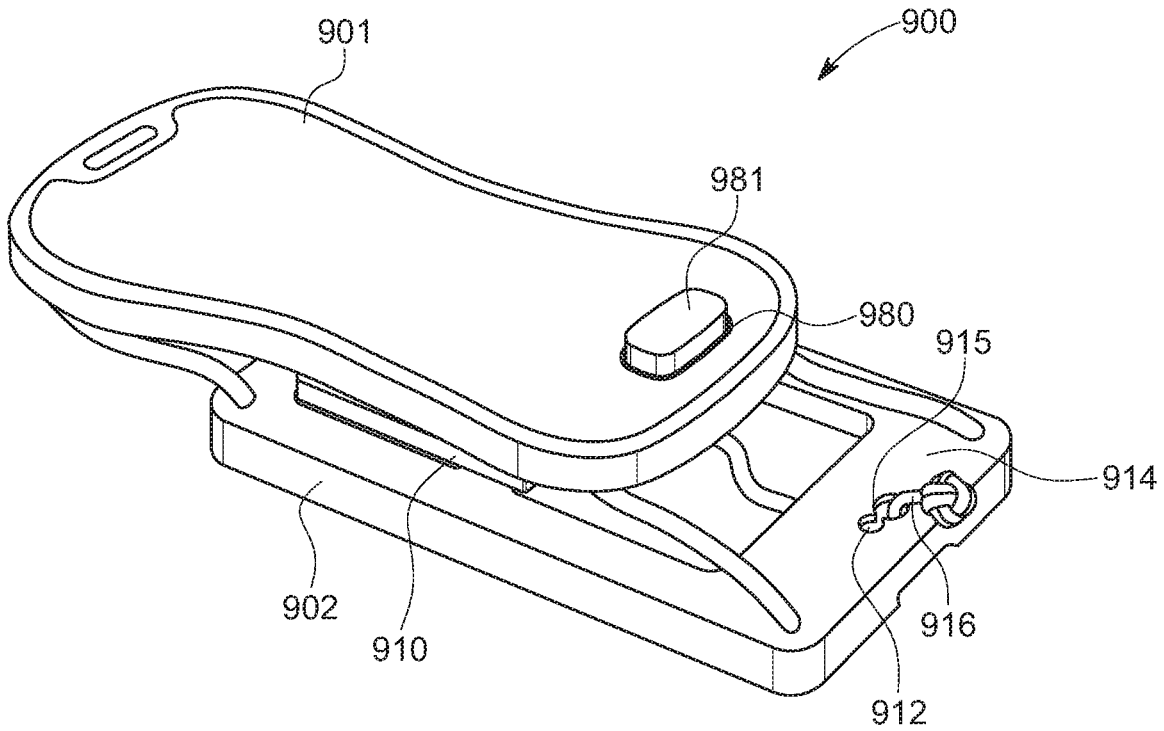
FIG. 26 is a perspective top, front view of the device of FIG. 25 in a closed configuration.
Figure 33:
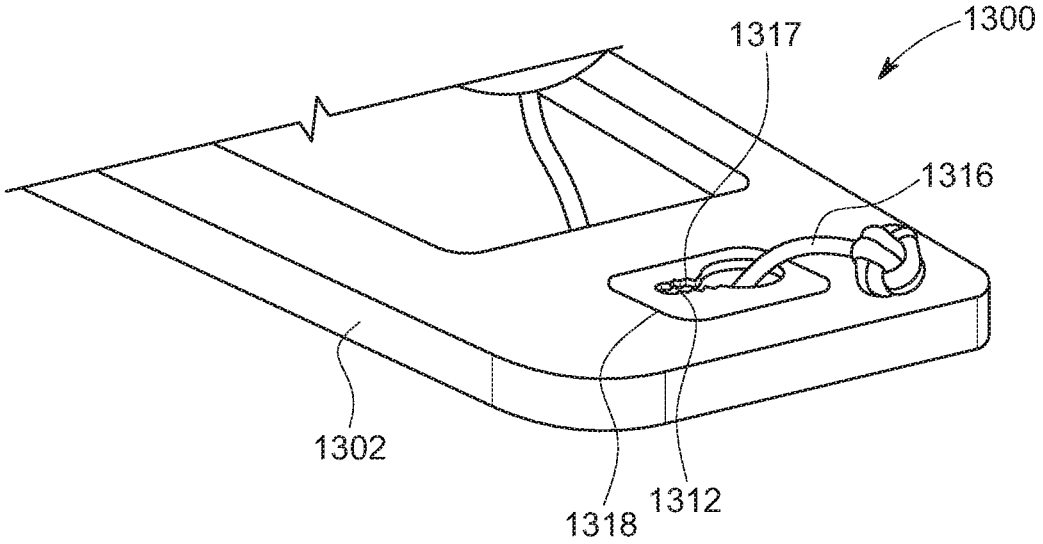
FIG. 33 is a partial, perspective top, front view of another embodiment of a portable exercise device in accordance with the present disclosure.
Figure 36:
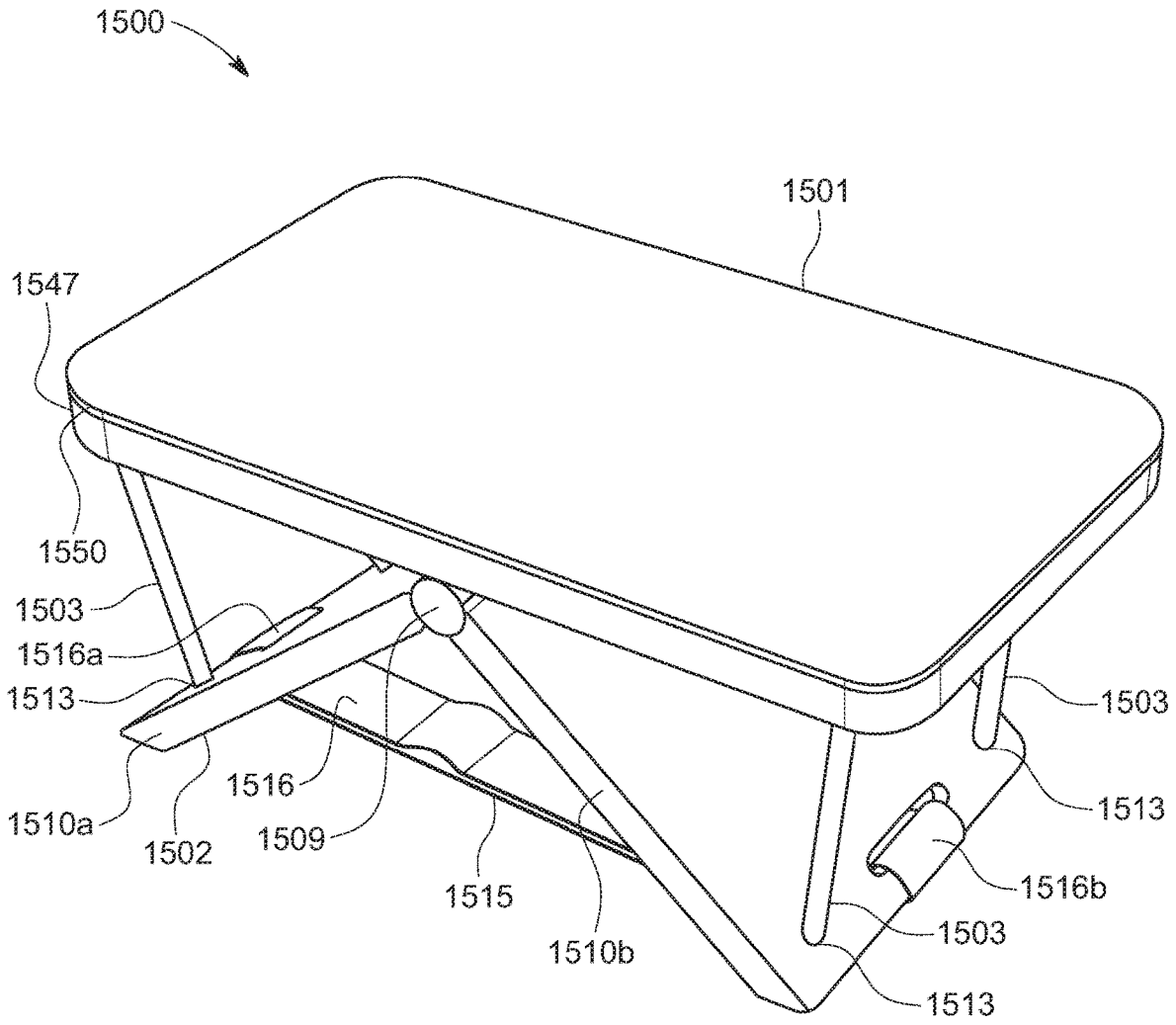
FIG. 36 is a perspective top, front view of another embodiment of a portable exercise device, in an open configuration, in accordance with the present disclosure.
Figure 40:
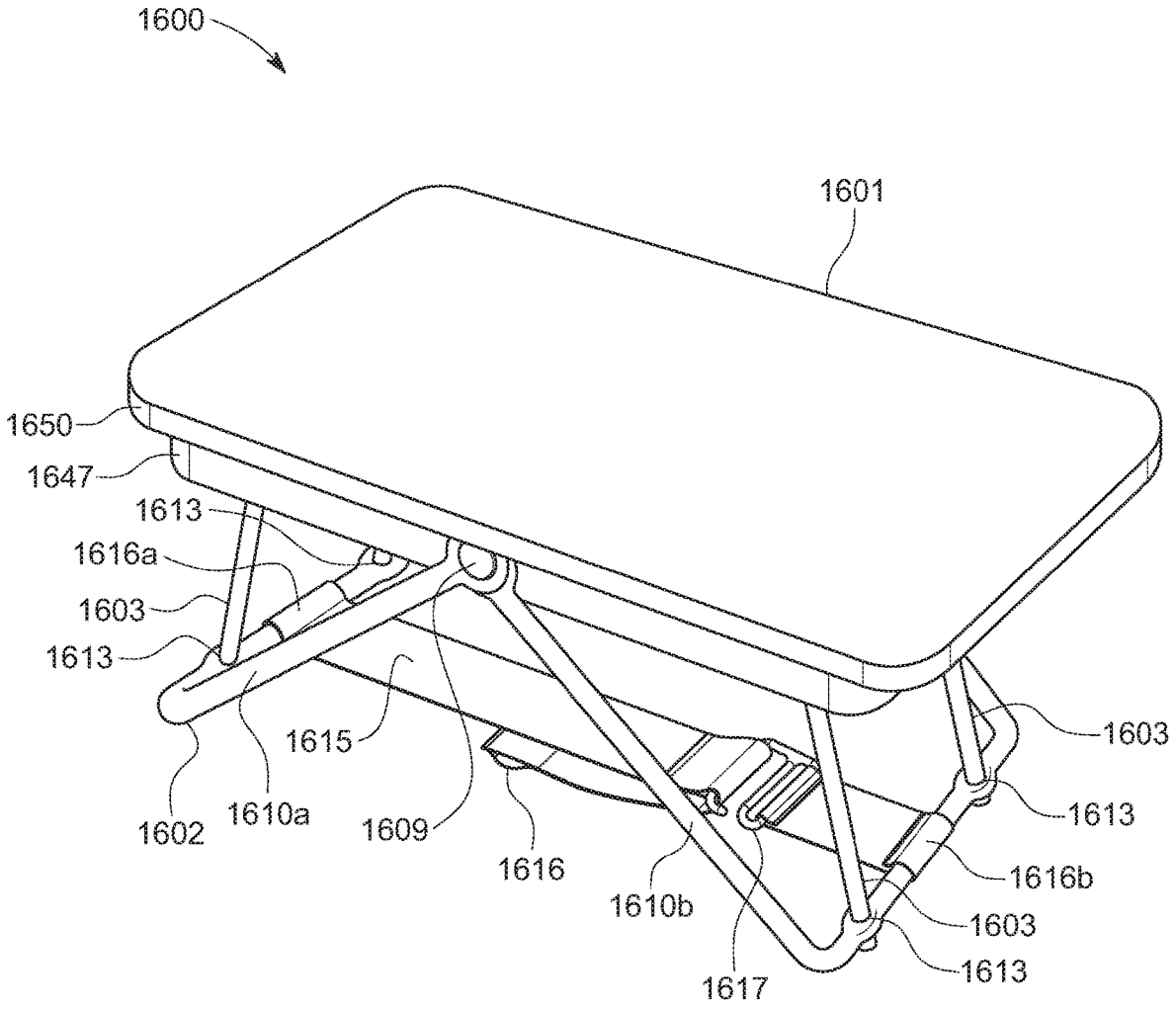
FIG. 40 is a perspective top, front view of another embodiment of a portable exercise device, in an open configuration, in accordance with the present disclosure.
Figure 41:
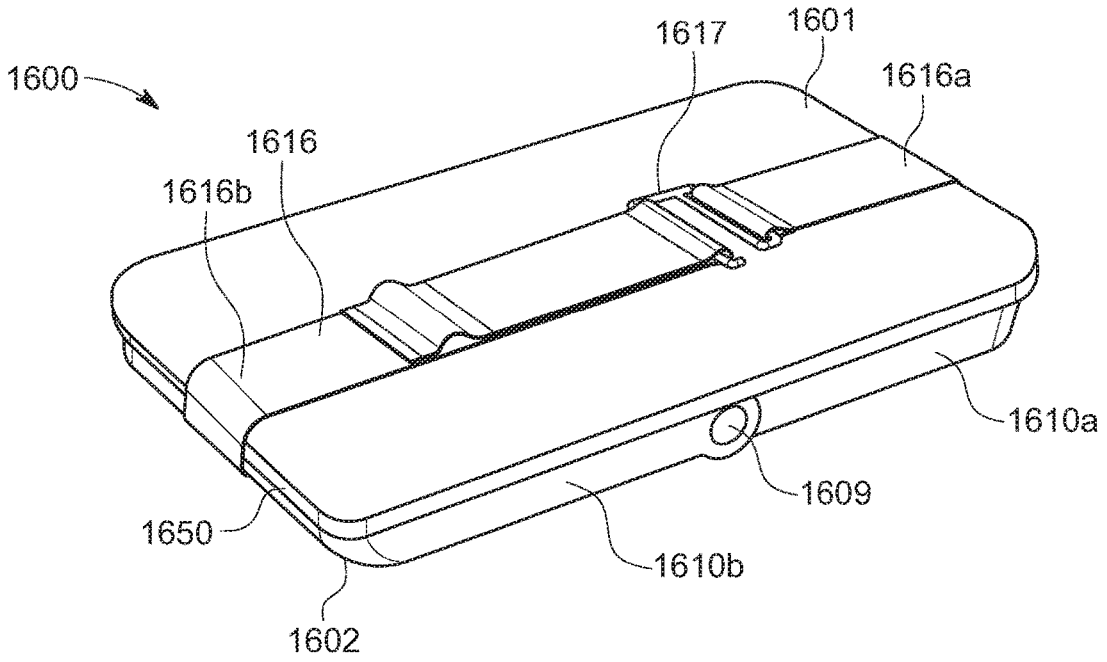
FIG. 41 is a perspective top, front view of the device of FIG. 40 in a closed configuration.
Figure 42:
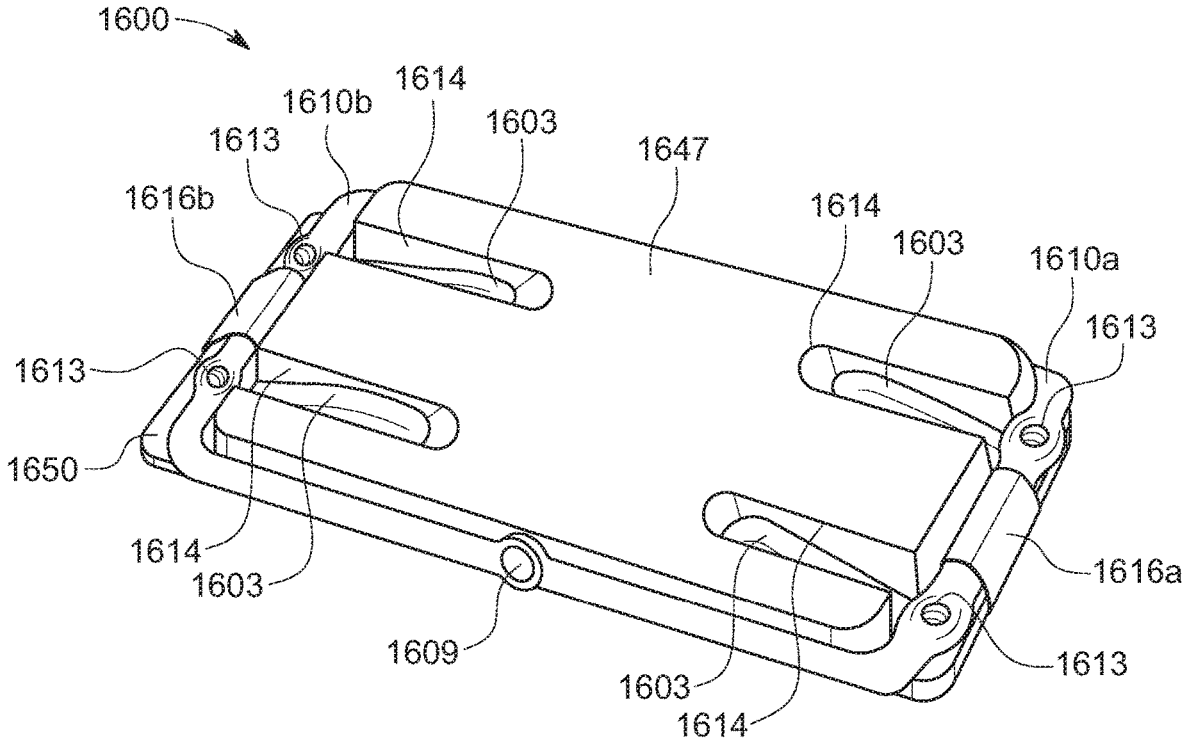
FIG. 42 is a perspective bottom view of the device of FIG. 40 in the closed configuration.

Those of ordinary skill in the art will further understand that various resistance mechanisms and locking mechanisms, as described above in FIGS. 1-22, may be used in conjunction with such wood devises. As illustrated in FIG. 23, for example, in one exemplary embodiment, similar to the embodiment of FIG. 22, the device 700 utilizes a locking mechanism comprising a plastic clamp 717. As illustrated in FIG. 33, in another exemplary embodiment, a device 1300 utilizes a locking mechanism comprising a plastic cleat 1317 that is embedded within a keyhole 1318 cut into a base 1302 of the device 1300. As will be understood by those of ordinary skill in the art, in such embodiments, to lock the device 1300 in the open configuration, the pedal may be raised and a cord 1316 may be locked within teeth 1312 of the cleat 1317. In other exemplary embodiments, similar to the embodiment of FIGS. 13A and 13B, the devices 800, 900, 1000, 1100 respectively utilize a cord 816, 916, 1016, 1116 that interconnects directly with the base 802, 902, 1002, 1102 such as, for example, with holes 812, 912, 1012, 1112 and 814, 914, 1014, 1114 or other features of the base 802, 902, 1002, 1102. For example, the device 800, 900, 1000, 1100 may have two differently sized holes 812, 912, 1012, 1112 and 814, 914, 1014, 1114 that are connected by a small channel 815 (not shown), 915 (see FIG. 26), 1015 (see FIG. 29), 1115 (see FIG. 31). The smaller of the two holes 812, 912, 1012, 1112 is configured to retain a small knot 813, 913, 1013, 1113 in the cord 816, 916, 1016, 1116 to lock the device 800, 900, 1000, 1100 in the open configuration (see FIGS. 24, 25, 28, and 30) and the larger of the two holes 814, 914, 1014, 1114 is configured to let the knot 813, 913, 1013, 1113 pass. In this manner, the device 800, 900, 1000, 1100 may be closed by tugging the cord 816, 916, 1016, 1116 through the channel 815, 915, 1015, 1115 to move the cord from the small hole 812, 912, 1012, 1112 to the large hole 814, 914, 1014, 1114. In still further exemplary embodiments, the devices 1500, 1600 utilize a locking mechanism 1515, 1615 that includes a strap (e.g., a soft goods strap) 1516, 1616 (including two strap portions) and a hook (e.g., a G-hook) 1517, 1617. The strap 1515, 1615 connects directly to each of the supports 1510*a*, 1610*a* and 1510*b*, 1610*b* and is adjusted (i.e., to lock the device 1500, 1600 in either the open or closed configuration) via the hook 1517, 1617. In the embodiment of FIGS. 36-39, for example, a respective strap portion 1516*a* and 1516*b* is connected to each support 1510*a* and 1510*b* via a notch 1512 in the base of each support 1510*a* and 1510*b*. And, in the embodiment of FIGS. 40-42, a respective strap portion 1616*a* and 1616*b* is configured to wrap around the base of each support 1610*a* and 1610*b* (i.e., around an aluminum tube forming the base of each support 1610*a* and 1610*b*). Thus, as illustrated in FIGS. 36 and 40, when the device 1500, 1600 is in the open configuration, the two strap portions 1516*a*, 1616*a* and 1516*b*, 1616*b* are connected via the hook 1517, 1617 such that the strap 1516, 1616 runs under the triangular body formed by the supports 1510*a*, 1610*a* and 1510*b*, 1610*b*. And, as illustrated in FIGS. 37 and 41, when the device 1500, 1600 is in the closed configuration, the two strap portions 1516*a*, 1616*a* and 1516*b*, 1616*b* are connected via the hook 1517, 1617 such that the strap 1516, 1616 runs over the birch top piece 1550, 1650.

As above, for portability it is also advantageous for devices in accordance with the present disclosure (including the wood devices) to have a low profile when in the closed configuration (i.e., to minimize the packing profile). Accordingly, as illustrated in the embodiments of FIGS. 25-31, various embodiments further contemplate utilizing components that lock together when the device is in the closed configuration. One embodiment, for example, contemplates utilizing a pair of components 980 and 981 that fit together in a tight manner (e.g., a press-fit or snap fit manner) when the device 900 is in the closed configuration. The components may, for example, include a rubber piece 981 on the support 910 that is configured to imbed within a hole 980 in the pedal 901 when the device 900 is in the closed configuration. Another embodiment contemplates utilizing components 1080 and 1081 that stick together when the device 1000 is in the closed configuration. The components may, for example, include a "hook-type" fastener material 1080 on the pedal 1001 (e.g., a Velcro® strip) that is configured to attach to a "loop-type" fastener material 1081 on the support 1002 (e.g., on the bottom surface of the support 1002) when the device 1000 is in the closed configuration. Another embodiment contemplates utilizing components that connect magnetically when the device 1100 is in the closed configuration. The components may, for example, include a magnet 1181 on a top surface of the support 1102 that is configured to connect to a magnet (not shown) on a bottom surface of the pedal 1101 when the device 1100 is in the closed configuration.

As illustrated in the embodiments of FIGS. 36-42, various additional embodiments contemplate utilizing a pedal 1501, 1601 and base 1502, 1602 that are configured to lay flush when the device 1500, 1600 is in the closed configuration. In the embodiment of FIGS. 36-39, for example, to place the device 1500 into the closed configuration, the wood supports 1510*a* and 1510*b* may rotate (via the hinge 1509) up against the pedal 1501 (i.e., such that they lay flat against an underside of the support 1547 of the pedal 1501), and the elastomeric bands 1503 are configured to nest internally within the support 1547 of the pedal 1501 (not shown). Similarly, in the embodiment of FIGS. 40-42, to place the device 1600 into the closed configuration, the aluminum supports 1610*a* and 1610*b* may rotate (via the hinge 1609) up against the pedal 1601 (i.e., such that they frame the support 1647 and lay flat against an underside of the top piece 1650 of the pedal 1601); and the elastomeric bands 1603 are configured to nest within cutouts 1614 in an underside of the support 1647 of the pedal 1601 (see FIG. 42).

Such components and configurations may serve to minimize the packing profile of the device 900, 1000, 1100, 1500, 1600 while also helping to secure the pedal 901, 1001, 1101, 1501, 1601 to the base 902, 1002, 1102, 1502, 1602 during transport. Also, as above, to provide both protection and containment (e.g., of any dirt or contaminants that the device 900, 1000, 1100, 1501, 1601 may have picked up during use), the device 900, 1000, 1100, 1501, 1601 may also be inserted into a storage sleeve 1200 as illustrated, for example, in FIG. 27.

As above, those of ordinary skill in the art will understand that the portable exercise devices described above with reference to the wood embodiments of FIGS. 23-31 and 36-42 are exemplary only, and that portable exercise devices in accordance with the present disclosure may comprise various types, numbers, configurations, and/or combinations of the above described elements and features without departing from the scope of the present teachings and claims.

In accordance with various exemplary embodiments of the present disclosure, an exemplary method for exercising muscles in an ankle, foot, and/or leg of a user 123 using the exercise device 100, as illustrated in the embodiments of FIGS. 1-13B, will now be described with reference to FIGS. 1-14. For use, the exercise device 100 may be placed in an open configuration, as shown in FIG. 1-7, 13A, and 13B. Alternatively, during travel or when otherwise storing and/or transporting the device 100, the exercise device 100 may be placed in a closed configuration, as shown in FIGS. 7-12. Consequently, exemplary methods for exercising in accordance with the present disclosure, contemplate that a configuration of the device 100 may be adjusted from a closed confirmation to an open configuration, wherein, as described above, in the closed configuration, the pedal 101 is collapsed against the base 102, and, in the open configuration, the pedal 101 is raised into an elevated position with respect to the base 102 to receive a foot 121 of a user 123.

The configuration of the device 100 may be adjusted from the closed configuration to the open configuration by lifting the pedal 101 off the base 102 and into a position substantially parallel to and aligned with the base 102, such that a space S is formed between the pedal 101 and the base 102. In various exemplary embodiments, the pedal 101 may be held in the open configuration position (neutral position) via the support 110, which is positioned between the pedal 101 and the base 102. As previously noted, the support 110 is connected to each of the pedal 101 and the base 102 via a respective hinge 109 and 111. The support 110 may, for example, be raised and lowered with respect to the base 102 (i.e., transitioned between an upright and collapsed configuration as described above) by respectively securing and releasing a cord 116 that is attached to the support 110. In other words, to raise the support 110 and maintain the support 110 in the upright configuration (and thereby raise the pedal 101 and maintain the device 100 in the open configuration), the cord 116 may be pulled taut and secured, for example, within a clamp 117. And, to lower the support 110 (and thereby lower the pedal 101 and place the device in the closed configuration) the cord 116 may be released from the clamp 117, such that the cord 116 is slackened to allow the support 110 to collapse against a top surface 145 of the base 102 via the hinges 109 and 111.

When in the open configuration, a foot 121 of the user 123, for example, a right foot 121 is set on the foot surface 150 of the pedal 101. Upon initial use of the exercise device 100, the pedal 101 may receive the user's 123 foot 121 in a neutral position N relative to a pivot axis P (see FIGS. 6 and 7). As shown for illustrative purposes in FIGS. 13A and 13B, using for example a right foot 121, the user 123 can rotate the pedal 101 in a first and second opposite directions, F and E respectively, about the pivot axis P against a resistive force Z exerted against the pedal 101 in a direction opposite to the rotating direction (i.e., opposite to the direction F or E). For example, the user 123 can rotate the pedal 101 in the first direction F about the pivot axis P to move a first end (e.g., the toe end portion 104) of the pedal 101 toward the base 102, while a force exerted (e.g., by a resistance mechanism 103) against a second end (e.g., the heel end portion 105) of the pedal 101 resists the pivoting motion. Likewise, the user 123 can rotate the pedal 101 in the second direction E about the pivot axis P to move the second end (e.g., the heel end portion 105) of the pedal 101 toward the base 102, while a force exerted (e.g., by the resistance mechanism 103) against the first end (e.g., the toe end portion 104) of the pedal 101 resists the pivoting motion. In this manner, rotating the pedal 101 in the first and second directions may cause a rocking movement of the pedal 101 about the pivot axis P. Thus, as illustrated in FIG. 13A, rotating the pedal 101 in the first direction F may comprise depressing a toe end portion 104 of the pedal 101 and, as shown in FIG. 13B, rotating the pedal 101 in the second direction E may comprise depressing a heel end portion 105 the pedal 101.

As explained above, in various exemplary embodiments, the amount of force exerted against the pedal 101 may vary with a degree of rotation θ of the pedal 101 about the pivot axis P (see FIG. 14), for example, the amount of force exerted against the pedal 101 may increase with the degree of rotation θ of the pedal 101 about the pivot axis P. In this way, the further away from the neutral position the user 123 rotates the pedal 101, the more force that is required by the user 123 to maintain the position of the pedal 101.

Although not shown, similarly, the device may be used with a left leg/left foot of the user 123. For example, in the same manner, the left foot may be set on the foot surface 150 of the pedal 101. As above, the user 123 can then rotate the pedal 101 in first and second opposite directions F and E about the pivot axis P against a force exerted against the pedal 101 in a direction opposite to the rotating direction (i.e., opposite to the direction F or E).

Various exemplary embodiments of the present disclosure, therefore, contemplate rotating the pedal 101 in the first and/or second opposite directions F and E to subject the corresponding foot of a user to both plantar flexion motion (e.g., with reference to FIG. 13A, movement of the toes of the foot 121 away from the shin, thereby contracting the calf muscle) and dorsiflexion motion (e.g., with reference to FIG. 13B, movement of the toes of the foot 121 toward the shin, thereby stretching the left calf muscle). In this manner, using the exercise devices in accordance with various exemplary embodiments of the present disclosure can exercise both dorsiflexor and plantar flexor muscle groups, providing full flexion and extension of the ankle joint to increase blood circulation in the lower extremities of the body.

In various exemplary embodiments of the present disclosure, for example, rotation of the pedal 101 in the direction F may subject the corresponding foot through up to about 75 degrees of plantar flexion (e.g., rotation ranging from about neutral to 75 degrees); and rotation of the pedal 101 in the direction E may subject the corresponding foot through up to about 60 degrees of dorsiflexion (e.g., rotation ranging from about neutral to −60 degrees).

Figure 32:
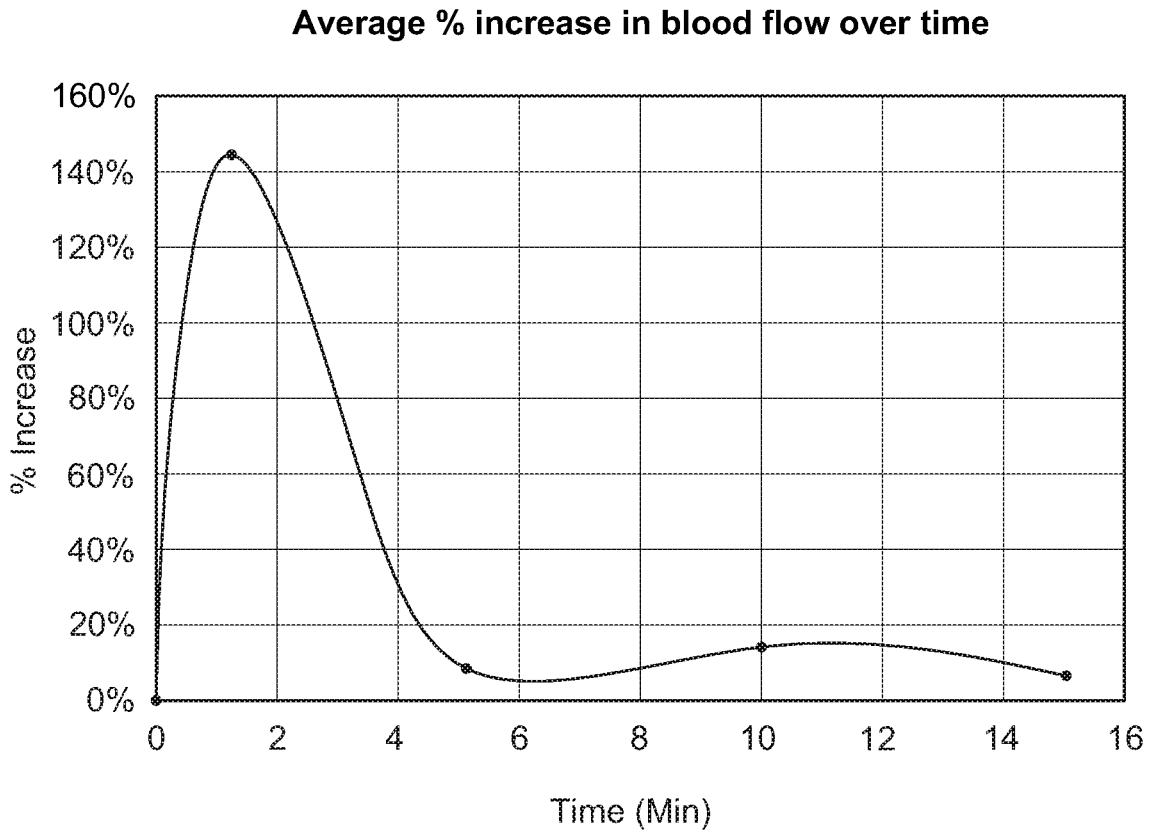
FIG. 32 is a graph illustrating the average percentage increase in blood flow over time during use of an exercise device in accordance with the present disclosure.

To demonstrate the efficacy of the devices, a clinical pilot study was performed using 12 healthy, adult volunteers. In the study, each participant used a similar device to the above device 100 to exercise, while being monitored by ultrasound Doppler using a linear probe. The subjects were seated at a sufficient height to achieve bent knees (90 degrees of flexion), with their right foot engaged with the device. Each subject rested in the seated position until blood flow parameters stabilized, after which time resting blood flow measurements were conducted. Blood vessel diameter measurements were taken using the ultrasound Doppler as visualized on the screen and the diameter was observed to remain constant before and through the exercise. Each participant then commenced with 1 minute of exercise, performing maximum effort right lower limb plantar/dorsiflexion maneuvers at 35 cycles per minute, as indicated by a metronome (i.e., wherein one cycle was defined as going from maximum dorsiflexion to maximum plantar flexion and back to the starting position). Blood flow measurements were then repeated immediately following completion of exercise, and then at 5 minutes, 10 minutes, and 15 minutes following completion of exercise. Post-exercise values for blood flow velocity and blood vessel diameter were then divided by pre-exercise values to calculate the respective ratios of each. The results of the clinical study are illustrated in FIG. 32, which plots the average percentage increase in blood flow over time for the participants. As shown in FIG. 32, on average, the participants experienced a significant improvement in blood flow velocity through the popliteal vein immediately after use, with the average increase in blood flow velocity at 1 minute being about 143%. The duration of continued increase in blood flow velocity relative to starting levels varied somewhat, but the average increase in blood flow velocity at 5 minutes was about 10%. Although the study specifically measured blood velocity, one of ordinary skill in the art, understanding the relationship between flow, velocity, and area (diameter of the vein) will understand that it is believed a corresponding increase in the volume of blood moving through the veins was realized.

Upon completion of an exercise session, exemplary methods in accordance with the present disclosure further contemplate that the configuration of the device 100 may be adjusted back from the open configuration to the closed configuration, for example, for storage, transport, or the like. In various embodiments, for example, the device 100 may be adjusted between the open configuration and the closed configuration by collapsing the pedal 101 against the base 102 to minimize the space S between the pedal 101 and the base 102. As above, the pedal 101 may be collapsed, for example, by lowering the support 110 with respect to the base 102 (i.e., transitioning the support 110 between the upright and collapsed configurations as described above) by releasing the cord 116 that is attached to the support 110.

It will be appreciated by those ordinarily skilled in the art having the benefit of this disclosure that the present disclosure provides various exemplary devices and methods for exercising muscles in an ankle, foot, and/or leg useful for increasing blood circulation in the lower extremities of the body. Furthermore, those ordinarily skilled in the art will understand that the disclosed exemplary devices and methods for exercising muscles in an ankle, foot, and/or leg may have other benefits and may treat other conditions, including, but not limited to, peripheral vascular disease, such as peripheral artery disease, PAD, and chronic venous insufficiency.

Further modifications and alternative embodiments of various aspects of the present disclosure will be apparent to those skilled in the art in view of this description. For example, although the particular examples and embodiments set forth herein contemplate an exercise device that receives one foot at a time, various additional exemplary embodiments in accordance with the present disclosure contemplate an exercise device that receives both feet at once, thereby simultaneously exercising muscles in both ankles, feet and/or legs.

Furthermore, the devices and methods may include additional components or steps that were omitted from the drawings for clarity of illustration and/or operation. Accordingly, this description is to be construed as illustrative only and is for the purpose of teaching those skilled in the art the general manner of carrying out the present disclosure. It is to be understood that the various embodiments shown and described herein are to be taken as exemplary. Elements and materials, and arrangements of those elements and materials, may be substituted for those illustrated and described herein, parts and processes may be reversed, and certain features of the present disclosure may be utilized independently, all as would be apparent to one skilled in the art after having the benefit of the description herein. Changes may be made in the elements described herein without departing from the spirit and scope of the present disclosure and following claims, including their equivalents.

It is to be understood that the particular examples and embodiments set forth herein are non-limiting, and modifications to structure, dimensions, materials, and methodologies may be made without departing from the scope of the present disclosure.

Furthermore, this description's terminology is not intended to limit the present disclosure. For example, spatially relative terms—such as "beneath", "below", "lower", "above", "upper", "bottom", "right", "left" and the like—may be used to describe one element's or feature's relationship to another element or feature as illustrated in the figures. These spatially relative terms are intended to encompass different positions (i.e., locations) and orientations (i.e., rotational placements) of a device in use or operation in addition to the position and orientation shown in FIGS. 1-12.

For the purposes of this specification and appended claims, unless otherwise indicated, all numbers expressing quantities, percentages or proportions, and other numerical values used in the specification and claims, are to be understood as being modified in all instances by the term "about" if they are not already. Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It should be understood that while the present disclosure have been described in detail with respect to various exemplary embodiments thereof, it should not be considered limited to such, as numerous modifications are possible without departing from the broad scope of the appended claims, including the equivalents they encompass.

We claim:

1. A portable exercise device comprising:

a pedal spaced away from and pivotably connected to a base and having a neutral position relative to a pivot axis, wherein each of the pedal and the base comprises a flat, rectangular body, the bodies having similar dimensions, and wherein the pedal is configured to rotate about the pivot axis in a first direction toward the base and in a second direction, opposite the first direction, toward the base; and a resistance mechanism configured to exert a force on the pedal about the pivot axis in a direction opposite to the respective first and second directions of rotation of the pedal about the pivot axis, wherein the device is movable between an open, in-use configuration, where the pedal is disposed in the neutral position to receive a foot of a user and spaced away from the base such that the pedal is parallel to the base and corners of the bodies are aligned with each other, and a closed configuration, where the pedal is disposed in the neutral position and is adjacent the base.

2. The exercise device of claim 1, wherein a space between the pedal and the base, in the open, in-use configuration of the device, is configured to allow sufficient rotation of the pedal in the first direction to subject the foot of the user to a full flexion and to allow sufficient rotation of the pedal in the second direction to subject the foot of the user to a full extension.

3. The exercise device of claim 1, wherein the resistance mechanism comprises at least one of an elastomeric band, a friction device, a torsion bar, a spring, an inflatable device, and a bellows.

4. The exercise device of claim 1, wherein the pedal comprises a toe end portion and a heel end portion, the pedal being pivotably mounted to the base midway between the toe end portion and the heel end portion via at least one hinge.

5. The exercise device of claim 1, wherein the pedal is pivotably connected to the base via a support positioned between a first hinge and a second hinge, the first hinge being connected to the pedal and the second hinge being connected to the base.

6. The exercise device of claim 5, wherein a height of the support is configured to allow sufficient rotation of the pedal in the first direction to subject the foot of the user to a full flexion and to allow sufficient rotation of the pedal in the second direction to subject the foot of the user to a full extension.

7. The exercise device of claim 1, wherein the resistance mechanism comprises a plurality of elastomeric bands.

8. The exercise device of claim 7, wherein at least one of the plurality of elastomeric bands extends between each of the respective aligned corners of the bodies.

9. The exercise device of claim 1, wherein the force provides a passive resistance to rotational movement of the pedal.

10. The exercise device of claim 1, wherein an amount of the force exerted by the resistance mechanism is variable.

11. The exercise device of claim 1, wherein rotation of the pedal in the first direction subjects the foot of the user to plantar flexion and rotation of the pedal in the second direction subjects the foot of the user to dorsiflexion, and wherein the force exerted against the pedal varies with a degree of rotation of the pedal about the pivot axis and away from the neutral position.

12. The exercise device of claim 1, wherein the device is configured to exercise muscles in an ankle, the foot, and/or a leg of the user to increase blood circulation.

13. The exercise device of claim 1, further comprising a closure mechanism, the closure mechanism being configured to transition the device between the open, in-use configuration and the closed configuration.

14. The exercise device of claim 1, wherein the pivot axis is located above the base, between the pedal and the base, or adjacent to a central portion of the pedal.

15. A portable exercise device comprising:

at least one pedal pivotably connected to a base via a support, the support being configured to move between an engaged position and a disengaged position, wherein the pedal has a neutral position relative to a pivot axis, the pedal comprising a toe end portion and a heel end portion, wherein the pivot axis is below the pedal and is centered between the toe end portion and the heel end portion, wherein the pedal is configured to rotate about the pivot axis in a first direction away from the neutral position in which the toe end portion moves toward the base and in a second direction away from the neutral position in which the heel end portion moves toward the base, such that rotation of the pedal in the first direction and the second direction, sequentially, moves the pedal in a rocking motion, a resistance mechanism configured to exert a force on the pedal about the pivot axis in a direction opposite to the respective first and second directions of rotation of the pedal about the pivot axis, and a closure mechanism configured to transition the device between an open configuration, in which the support is in the engaged position and the pedal is disposed in the neutral position to receive a foot of a user, and a closed configuration, in which the support is in the disengaged position and the pedal is collapsed against the base.

16. The exercise device of claim 15, wherein the resistance mechanism comprises at least one first elastomeric band extending between the toe end portion and the base and at least one second elastomeric band extending between the heel end portion and the base.

17. The exercise device of claim 15, wherein the support is positioned between a first hinge and a second hinge, the first hinge being connected to the pedal and the second hinge being connected to the base.

18. The exercise device of claim 17, wherein a height of the support is configured to allow sufficient rotation of the pedal in the first direction to subject a foot of a user to full flexion and to allow sufficient rotation of the pedal in the second direction to subject the foot of the user to full extension.

19. The exercise device of claim 18, wherein the height of the support is greater than half a length of the pedal.

20. A portable exercise device comprising:

at least one pedal pivotably connected to a base via a support positioned between a first hinge and a second hinge, the first hinge being connected to the pedal and the second hinge being connected to the base, wherein the pedal has a neutral position relative to a pivot axis, the pedal comprising a toe end portion and a heel end portion, wherein the pivot axis is below the pedal and is approximately centered between the toe end portion and the heel end portion, wherein the pedal is configured to rotate about the pivot axis in a first direction away from the neutral position in which the toe end portion moves toward the base and in a second direction away from the neutral position in which the heel end portion moves toward the base, such that rotation of the pedal in the first direction and the second direction, sequentially, moves the pedal in a rocking motion, and a resistance mechanism configured to exert a force on the pedal about the pivot axis in a direction opposite to the respective first and second directions of rotation of the pedal about the pivot axis.

* * * * *